US008602864B1

(12) United States Patent
Lewis

(10) Patent No.: US 8,602,864 B1
(45) Date of Patent: Dec. 10, 2013

(54) METHOD AND DEVICE FOR CONDUCTING A NUMBERS GAME WITH A PRIZE COMPONENT

(71) Applicant: Stanley Lewis, Las Vegas, NV (US)

(72) Inventor: Stanley Lewis, Las Vegas, NV (US)

( * ) Notice: Subject to any disclaimer, the term of this patent is extended or adjusted under 35 U.S.C. 154(b) by 0 days.

(21) Appl. No.: 13/757,764

(22) Filed: Feb. 2, 2013

(51) Int. Cl.
*A63F 9/00* (2006.01)

(52) U.S. Cl.
USPC ..... 463/18

(58) Field of Classification Search
USPC ..... 463/18, 19, 43
See application file for complete search history.

(56) References Cited

U.S. PATENT DOCUMENTS 6,079,711 A * 6/2000 Wei et al. ..... 273/269
6,656,044 B1 * 12/2003 Lewis ..... 463/19
7,614,948 B2 * 11/2009 Saffari et al. ..... 463/19
7,837,550 B2 * 11/2010 Odom ..... 463/19
7,901,282 B2 * 3/2011 Cannon ..... 463/18
8,113,939 B2 * 2/2012 Cannon ..... 463/18
8,123,607 B2 * 2/2012 Van Asdale ..... 463/19
2006/0121976 A1 * 6/2006 Odom ..... 463/19

* cited by examiner

*Primary Examiner* — Seng H Lim
(74) *Attorney, Agent, or Firm* — Robert Ryan Morishita; Morishita Law Firm, LLC

(57) ABSTRACT

At least one game matrix is generated. Number indicia are selected and any matches between the selected number indicia and the game matrix are identified. The numbers game component is resolved based on the identified matches. One or more game hands are formed by assigning a prize indicium and/or game indicium to each match. Optionally, game indicia are randomly assigned to game matrix locations lacking a match. In an embodiment based on Bingo, a game hand may be formed based on the pattern of matches. The game hand component of a game is resolved based on a comparison of the game hand to a standard, such as a pay table, dealer hand, and/or other game hands of other players. A prize component is resolved based on whether a predetermined collection of prize indicia is obtained.

5 Claims, 21 Drawing Sheets

300

302

| | | | | |
|---|---|---|---|---|
| 5 | 25 | 41 | 53 | 62 |
| 11 | 18 | 35 | 51 | 65 |
| 3 | 28 | FREE | 48 | 71 |
| 10 | 22 | 45 | 52 | 69 |
| 1 | 19 | 31 | 60 | 73 |

| | | | | |
|---|---|---|---|---|
| 10 | 18 | 32 | 47 | 74 |
| 14 | 22 | 35 | 56 | 62 |
| 12 | 27 | FREE | 52 | 64 |
| 8 | 24 | 41 | 59 | 75 |
| 6 | 16 | 37 | 49 | 70 |

| | | | | |
|---|---|---|---|---|
| 11 | 30 | 33 | 59 | 66 |
| 3 | 17 | 39 | 47 | 68 |
| 7 | 21 | FREE | 60 | 61 |
| 15 | 20 | 44 | 48 | 63 |
| 9 | 26 | 42 | 55 | 72 |

300

302

| | | | | |
|---|---|---|---|---|
| 5 | 25 | 41 | 53 | 62 |
| 11 | 18 | 35 | 51 | 65 |
| 3 | 28 | FREE | 48 | 71 |
| 10 | 22 | 45 | 52 | 69 |
| 1 | 19 | 31 | 60 | 73 |

| | | | | |
|---|---|---|---|---|
| 10 | 18 | 32 | 47 | 74 |
| 14 | 22 | 35 | 56 | 62 |
| 12 | 27 | FREE | 52 | 64 |
| 8 | 24 | 41 | 59 | 75 |
| 6 | 16 | 37 | 49 | 70 |

| | | | | |
|---|---|---|---|---|
| 11 | 30 | 33 | 59 | 66 |
| 3 | 17 | 39 | 47 | 68 |
| 7 | 21 | FREE | 60 | 61 |
| 15 | 20 | 44 | 48 | 63 |
| 9 | 26 | 42 | 55 | 72 |

300

302

| | | | | |
|---|---|---|---|---|
| 5 / 2♠ | 25 | 41 / J♣ | 53 | 62 / Q♢ |
| 11 / 2♣ | 18 | 35 / 5♣ | 51 | 65 |
| 3 / J♢ | 28 | FREE | 48 / 8♠ | 71 |
| 10 / 7♡ | 22 / 8♣ | 45 | 52 | 69 |
| 1 / A♣ | 19 | 31 | 60 | 73 |

304 400

| | | | | |
|---|---|---|---|---|
| 2♠ | 2♣ | J♢ | 7♡ | A♣ |
| HOLD | HOLD | | | |

| | | | | |
|---|---|---|---|---|
| 10 | 18 | 32 | 47 | 74 / 3♠ |
| 14 / Q♡ | 22 / 8♣ | 35 / 5♣ | 56 / 5♡ | 62 / Q♢ |
| 12 | 27 | FREE | 52 | 64 |
| 8 | 24 | 41 / J♣ | 59 / 4♢ | 75 |
| 6 | 16 | 37 | 49 | 70 |

| | | | | |
|---|---|---|---|---|
| Q♡ | 8♣ | 5♣ | 5♡ | Q♢ |
| HOLD | | HOLD | HOLD | HOLD |

| | | | | |
|---|---|---|---|---|
| 11 / 2♣ | 30 | 33 | 59 / 4♢ | 66 |
| 3 / J♢ | 17 / 6♠ | 39 | 47 | 68 |
| 7 | 21 | FREE | 60 | 61 |
| 15 | 20 | 44 / 9♣ | 48 / 8♠ | 63 |
| 9 | 26 / 4♡ | 42 | 55 | 72 / 6♢ |

| | | | | |
|---|---|---|---|---|
| 2♣ | 6♠ | WILD | 8♠ | 6♢ |
| | HOLD | HOLD | | HOLD |

*FIG. 5*

300

302

| | | | | |
|---|---|---|---|---|
| 5 / 2♠ | 25 | 41 / J♣ | 53 | 62 / Q♢ |
| 11 / 2♣ | 18 | 35 / 5♣ | 51 | 65 |
| 3 / J♢ | 28 | FREE | 48 / 8♠ | 71 |
| 10 / 7♡ | 22 / 8♣ | 45 | 52 | 69 |
| 1 / A♣ | 19 | 31 | 60 | 73 |

304 400

| | | | | |
|---|---|---|---|---|
| 2♠ | 2♣ | 3♣ | K♢ | 4♡ |
| HOLD | HOLD | | | |

| | | | | |
|---|---|---|---|---|
| 10 | 18 | 32 | 47 | 74 / 3♠ |
| 14 / Q♡ | 22 / 8♣ | 35 / 5♣ | 56 / 5♡ | 62 / Q♢ |
| 12 | 27 | FREE | 52 | 64 |
| 8 | 24 | 41 / J♣ | 59 / 4♢ | 75 |
| 6 | 16 | 37 | 49 | 70 |

| | | | | |
|---|---|---|---|---|
| Q♡ | 5♠ | 5♣ | 5♡ | Q♢ |
| HOLD | | HOLD | HOLD | HOLD |

| | | | | |
|---|---|---|---|---|
| 11 / 2♣ | 30 | 33 | 59 / 4♢ | 66 |
| 3 / J♢ | 17 / 6♠ | 39 | 47 | 68 |
| 7 | 21 | FREE | 60 | 61 |
| 15 | 20 | 44 / 9♣ | 48 / 8♠ | 63 |
| 9 | 26 / 4♡ | 42 | 55 | 72 / 6♢ |

| | | | | |
|---|---|---|---|---|
| 7♡ | 6♠ | WILD | J♣ | 6♢ |
| | HOLD | HOLD | | HOLD |

*FIG. 6*

700

| | | | | | | | | | |
|---|---|---|---|---|---|---|---|---|---|
| 1 | 2 | 3 J♠ | 4 | 5 4♢ | 6 | 7 | 8 | 9 | 10 |
| 11 | 12 | 13 | 14 | 15 | 16 | 17 | 18 | 19 | 20 |
| 21 | 22 K♠ | 23 | 24 | 25 | 26 | 27 | 28 | 29 | 30 |
| 31 | 32 | 33 | 34 | 35 5♢ | 36 | 37 | 38 | 39 | 40 |
| 41 | 42 | 43 | 44 | 45 | 46 | 47 | 48 | 49 | 50 |
| 51 | 52 | 53 | 54 | 55 A♠ | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

702

800

| K♠ | J♠ | 6♢ | 2♢ | A♠ |
|---|---|---|---|---|
| HOLD | HOLD | | | HOLD |

704

| | | | | | | | | | |
|---|---|---|---|---|---|---|---|---|---|
| 1 | 2 | 3 | 4 | 5 4♢ | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 8♢ | 34 | 35 5♢ | 36 | 37 | 38 | 39 | 40 |
| 41 A♠ | 42 | 43 | 44 | 45 2♢ | 46 | 47 | 48 | 49 | 50 |
| 51 | 52 | 53 | 54 | 55 A♠ | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

| K♣ | 7♢ | 7♡ | A♣ | A♠ |
|---|---|---|---|---|
| | | | HOLD | HOLD |

*FIG. 9*

| | | | | |
|---|---|---|---|---|
| 10 | 18 | 32 | 47 | 74 |
| 14 NEW YORK | 22 | 35 | 56 | 62 |
| 12 | 27 | FREE | 52 | 64 |
| 8 | 24 | 41 | 59 FREE GAME | 75 |
| 6 | 16 | 37 GIFT CARD | 49 | 70 |

INSTANT WINNER - FREE GAME

| | | | | |
|---|---|---|---|---|
| 10 | 18 | 32 | 47 | 74 |
| 14 NEW YORK | 22 | 35 | 56 CAR | 62 |
| 12 | 27 | FREE | 52 | 64 |
| 8 | 24 | 41 | 59 FREE GAME | 75 |
| 6 | 16 | 37 GIFT CARD | 49 | 70 |

CONGRATULATIONS! - BINGO

| | | | | |
|---|---|---|---|---|
| 6 | 29 | 40 / 10♤ | 53 | 74 / 10♤ |
| 7 | 20 | 42 / 7♢ | 46 | 64 |
| 12 / A♡ TRIP | 22 | JOKER | 47 / 7♡ | 68 / J♢ CAR |
| 11 | 18 / 2♤ | 32 | 58 | 75 |
| 3 / 6♤ | 17 | 32 / 3♡ TRIP | 51 | 70 |

METHOD AND DEVICE FOR CONDUCTING A NUMBERS GAME WITH A PRIZE COMPONENT

RELATED APPLICATION DATA

The present application is a continuation-in-part of U.S. patent application Ser. No. 13/353,245, entitled "Method and Device for Conducting a Numbers Game with a Game Hand Component," filed Jan. 18, 2012 by Applicant herein.

FIELD OF THE INVENTION

The present invention relates to wagering games. More specifically, the present invention relates to an electronic game which includes play of a prize game with conduct of a numbers game, sweepstakes, lottery, or the like.

BACKGROUND OF THE INVENTION

It has been known to provide electronic gaming devices wherein a player can make a wager of a credit, tokens or the like and play what is commonly known as video poker. In video poker, the gaming device is provided with a processor which includes a data structure storing data representing each of the fifty-two playing cards of a deck of playing cards, and in some instances where the game includes a wild joker, a fifty-third card representing the aforementioned wild joker. The player makes the wager and prompts the game to randomly select five cards from the data structure and display those cards at a video display to define the initial hand. The player has the option of discarding none, some or all of the cards of the initial hand and receiving replacements for the discarded cards randomly selected from the data structure in an effort to better his hand and produce a final hand. The card combination of the final hand is compared by the processor to a schedule of winning outcomes to determine of the player has a winning or losing outcome. Typically winning outcomes are based upon poker rankings of the final hand.

A heretofore unrelated game is bingo. In bingo a player buys a bingo card which consists of a 5×5 matrix of numbers arranged under columns identified by the letters B-I-N-G-O. A device selects balls each designated by one of the column letters and a number, e.g. B27. If the column letter and number correspond to a number on the player's card, the player marks the coordinate on the card. The selection of balls continues until a player obtains a winning pattern of marked coordinates on his card. The winning pattern may be a column, row, diagonal, corners or a completely marked card. The player first obtaining the designated winning pattern, is the winner of the game.

Some electronic games which incorporate the principles of bingo are disclosed in Helm et al. U.S. Pat. No. 4,743,024 and Falciglia U.S. Pat. No. 5,647,798, the disclosures of which are hereby incorporated by reference.

There is also a parlor game known as Pokeno wherein a plurality of cards are printed on playing cards, each defining a matrix. At each coordinate of the matrix there is a depiction of a playing card. To play the game, a player selects one or more playing cards and cards from a deck of cards are turned over from a deck of cards and are used like balls in bingo, to identify coordinates on the card matrix to be marked by the player. Again the game may be played by designating the winner as the first player to mark a straight column, diagonal, row, diagonal, corners, a completely filled card or any other predetermined pattern. Playing cards are drawn in succession until a winner is declared.

Video poker is a very popular game. However, if the player does not obtain a winning hand after several plays, the game can become frustrating. Unless a winning hand is obtained, the player has no opportunity to receive a reward. There is a need to provide a device and method where a video poker player has at least one other opportunity, unrelated to his video poker hand, to obtain a winning outcome. Further, it would be advantageous to incorporate the other popular and familiar game of bingo into and conjunction with the play of video poker.

There are many games in which a player set is compared to a draw set to determine whether the player has won the game. Examples of such games include Bingo, in which the player set is assigned to the player through a Bingo card, and Keno, in which the player selects the player set from a closed set.

For example, in Bingo a player buys a Bingo card which, in a typical game, consists of a 5×5 matrix of numbers arranged under columns identified by the letters B-I-N-G-O. A device selects balls each designated by one of the column letters and a number, e.g. B-27. If the column letter and number correspond to a number on the player's card, the player marks the coordinate on the card. The selection of balls continues until a player obtains a winning pattern of marked coordinates on his card. The winning pattern may be a column, row, diagonal, corners or a completely marked card. The player first obtaining the designated winning pattern, is the winner of the game.

The application of a Poker game to a Bingo game is disclosed in my prior U.S. Pat. No. 6,656,044. In my game, a player receives at least one Bingo card. As numbers are drawn, a playing card value is assigned to the Bingo number. For example, the Bingo number "B-15" may be assigned the playing card value "4♡". The result is that any player with a B-15 on his or her Bingo card obtains a 4♡ in the position of the B-15. Upon the player or a competitor completing a predetermined pattern (such as a BINGO), the player's Bingo card is examined for patterns that may constitute winning poker hands. For example, if a column of the player's Bingo card includes the cards 3♠ 4♡ 5♢ 6♡ 7♣), the player would be rewarded for a straight.

The most well known numbers game is Racehorse Keno, referred to in casinos as Race Keno or merely Keno. Keno uses eighty numbers, typically the numbers one through eighty. In Keno, players may wager any amount on a Keno ticket. Players make selections by marking selected numbers on the Keno ticket. At predetermined intervals, the house selects twenty numbers. If the numbers selected by the house match a predetermined percentage of numbers selected by a player, the player is rewarded. The payoff is determined by the quantity of matched numbers.

Wagers in Keno can be generally divided into two groups, spot and way. Spot wagers consist of the player merely selecting individual numbers, or spots, on a Keno ticket. If a player catches a predetermined number of spots, the player is rewarded. For example, on a ten-spot Keno ticket, the player selects and marks ten numbers. A reward is issued if the player catches five or more spots. Typically, the reward increases with the number of spots the player catches. For example, if the player catches five spots, the player may receive his wager back; if the player receives ten spots, the player may be paid at ten thousand to one.

Way wagers consist of a player selecting groups of adjacent numbers, or ways, on a Keno ticket. If a player catches a predetermined number of spots, the player is rewarded. Unlike spot wagers, however, the reward in a way wager depends on how the spots the player catches are distributed. For example, on a hi-low way Keno ticket, the player selects and marks three groups of four adjacent numbers. If a player catches five or more spots, the player is rewarded. However, the size of the reward depends on the distribution of the spots. For example, if the spots are distributed with two in one way, two in another way, and one in yet another way (2-2-1), the player's wager is returned. Alternatively, if the spots are distributed 3-1-1, the player may be paid at 1.2:1; if the spots are distributed 4-1, the player may be rewarded at 1.4:1.

The drawback of Keno is the inherent tension in the number of spots marked and the number of catches required for a payout. That is, players who wish to select a large number of spots are discouraged by the large number of catches required to win or break even. Similarly, there is no "second chance" in Keno that allow a player the opportunity to win even if the required number of catches is missed. Given that Keno has one of the highest house advantages among casino games, many players avoid Keno. Moreover, Keno, for many players, is unexciting. There is little strategy in the game and little entertainment from watching numbers appear on a display board.

Therefore, there is a need in the art for a device and method for the play of a numbers game, such as Keno and Bingo, where the use of a playing card component, such as Poker, makes the game more entertaining and gives the player an additional opportunity to win while benefiting the operator by encouraging the player to increase the player's play.

SUMMARY OF THE INVENTION

The present invention includes a method for conducting a game at an electronic device. In an optional embodiment, the electronic device includes a data processor in communication with a display, a data storage device, and a player interface. At least one matrix template having a plurality of matrix positions is stored at the data storage device. In an optional embodiment, the matrix template includes a rectangular pattern of matrix positions arranged in columns and rows. A plurality of number indicia is stored at the data storage device. In an optional embodiment, number indicia may include Bingo numbers, Keno numbers, or the like. A plurality of prize indicia is stored at the data storage device. In one optional embodiment, the prize indicia may be prize cards, playing cards, or a combination thereof.

In one optional embodiment, the game is conducted in response to a wager. In one such optional embodiment, one or more wagers are received through the player interface. In an alternate optional embodiment, the games do not require a wager (i.e., free, subscription-based, or fee-based).

At least one game matrix is generated by the data processor by assigning a plurality of number indicia to a plurality of matrix positions in a plurality of matrix templates. Optionally, the game matrix is displayed at the display.

The games are resolved by the data processor which randomly selects an outcome set of number indicia and compares the outcome set to the game matrix. Each match between the outcome set and a number indicium in the game matrix is identified. A winner is determined for the game matrix based on predetermined patterns of matches in the game matrix. In an optional embodiment, the predetermined pattern of matches in the game matrix comprises at least one of a row, a column, a diagonal, and the four corners of the game matrix. In an optional embodiment, an award may be issued for a winning game matrix.

The data processor randomly selects a prize indicium to correspond to each match. As noted above, the prize indicia may take many different forms including prize cards, playing cards, or combinations thereof. In an optional embodiment, prize cards may be randomly selected for each match from a defined deck of prize cards without replacing used prize cards back into the deck. In an alternate optional embodiment, prize cards may be randomly selected for each match from a separate deck of prize cards for each game matrix. In an optional embodiment a deck of prize cards may include certain prize cards with prize indicia and other cards with blank indicia. In this manner, it may be possible to draw a prize card (or multiple prize cards) without actually receiving any prize indicia or receiving a quantity of prize indicia less than the total number of prize cards drawn.

Prize indicia are collected. In one optional embodiment, prize indicia are grouped based on a predetermined pattern of matches in the game matrix. Again, as noted above, the predetermined pattern of matches in one such optional embodiment may include rows, columns, diagonals, corners, or the like within a rectangular or square game matrix. In another optional embodiment, prize indicia throughout the game matrix or game matrices may be collected together. In an optional embodiment, prize indicia may be collected over multiple serial games. In one such optional embodiment, prize indicia may expire after being held for a defined quantity of games; in an alternate optional embodiment, prize indicia may have no expiration. In a further optional embodiment, multiple players may form "teams" to aggregate prize indicia collected by the players on the team.

A prize, if any, is determined based on the collection of prize indicia. In one optional embodiment, awards may be instant insofar as only one prize indicia is required to award a prize. In an additional or alternate optional embodiment, multiple prize indicia may be required to award a prize. As noted above, prize indicia may be collected over multiple games and/or by multiple players. In an optional embodiment in which multiple players aggregate prize indicia, team prizes, e.g., prizes shared among players on a team, may be awarded as well as, or in place of, prizes to individual players. In an optional embodiment, an award is determined by comparing the collection of prize indicia to a table or database of prizes and the collection of prize indicia required to trigger an award.

An optional embodiment may be directed to a multi-player game. In one such optional embodiment, a method is provided for conducting a game at a plurality of electronic devices. In one such optional embodiment, each electronic device includes a data processor in communication with a display, a data storage device, and a player interface. Optionally, the electronic devices communicate with a game server.

At least one matrix template having a plurality of matrix positions is stored at each data storage device. A plurality of number indicia and a plurality of prize indicia are also stored at each data storage device.

In an optional embodiment, a wager is received through the player interface. In another optional embodiment, the game is free or subscription-based, fee-based, or token-based.

At least one game matrix is generated by each data processor by assigning a plurality of number indicia to a plurality of matrix positions in at least one matrix template. A game matrix is displayed at each display.

A game is conducted by the game server. An outcome set of number indicia is randomly selected by the game server, optionally through a hardware or software random number generator, ball blower, or the like. The outcome set is compared to the game matrix by the data processor and each match between the outcome set and a number indicium in the game matrix is identified. A winner, if any, is determined for the game matrix based on predetermined patterns of matches in the game matrix. For example, in one optional embodiment, the matrix template includes a rectangular pattern of matrix positions arranged in columns and rows and the predetermined pattern of matches in the game matrix includes at least one of a row, a column, a diagonal, and the four corners of the game matrix. Optionally, an award may be issued for a winning game matrix.

A prize indicium is randomly selected to correspond to each match. In an optional embodiment, the prize indicia include prize cards, playing cards, or a combination thereof. In one such optional embodiment, a deck of prize cards is defined such that each prize card randomly selected to correspond to each match on the game matrix is selected from a single deck. As may be appreciated, the server may store a single deck of prize cards for selection for all players. In this manner, the probability of the occurrence of prizes throughout the multiple games and multiple players participating may be determined.

Prize indicia are collected. In one optional embodiment, prize indicia are grouped based on a predetermined pattern of matches in the game matrix into at least one game hand. Again, the predetermined pattern of matches could include rows, columns, diagonals, four corners, or the like. Alternatively, prize indicia may be grouped throughout a game matrix or set of game matrices, grouped randomly, grouped based on a selection by a data processor, grouped based on a selection by a player, or any other grouping.

A prize, if any, is determined from the prize indicia. In one optional embodiment, the prize is determined by comparing the collection of prize indicia to a table or database that identify the collection of prize indicia needed to win a prize.

As noted above, in an optional embodiment, prize indicia may be stored at a device and collected over multiple games, with a prize awarded based on prize indicia collected over multiple games. In an additional or alternate optional embodiment, prize indicia may be aggregated across multiple devices (e.g., from multiple players) forming a "team." In such an optional embodiment, prizes may be awarded to the team and/or to individuals within a team.

Also disclosed is a game in which one or more wagers are received through the player interface. In response to receipt of the wager(s), at least one game matrix is generated by the data processor by assigning a plurality of number indicia to a plurality of matrix positions in a plurality of matrix templates. Optionally, the game matrix are displayed at the display.

The wager(s) are resolved by the data processor which randomly selects an outcome set of number indicia and compares the outcome set to the game matrix. Each match between the outcome set and a number indicium in the game matrix is identified. An award, if any, is determined for the game matrix based on predetermined patterns of matches in the game matrix. In an optional embodiment, the predetermined pattern of matches in the game matrix comprises at least one of a row, a column, a diagonal, and the four corners of the game matrix.

The data processor randomly selects a game indicium to correspond to each match. The game indicia may take many different forms including playing cards. In an optional embodiment, playing cards may be randomly selected for each match from a defined deck of playing cards without replacing used playing cards back into the deck. In an alternate optional embodiment, playing cards may be randomly selected for each match from a separate deck of playing cards for each game matrix. Each randomly selected game indicium is placed at the location in the game matrix of the corresponding match. The data processor randomly selects a game indicium for each location in the game matrix without a match, thereby "filling in" the game matrix. In an optional embodiment, the "fill in" game indicia (e.g., playing cards) are drawn from the defined deck of playing cards excluding playing cards previously dealt to the matrix positions containing a match.

Game indicia are grouped into at least one game hand based on a predetermined pattern of matches in the game matrix. Again, as noted above, the predetermined pattern of matches in one such optional embodiment may include rows, columns, diagonals, corners, or the like within a rectangular or square game matrix. In an optional embodiment, a plurality of game hands are formed.

BRIEF DESCRIPTION OF THE DRAWINGS

FIG. 5 is a front view of a display of an example game according to the embodiment of FIG. 3;

FIG. 6 is a front view of a display of an example game according to an embodiment of FIG. 3;

FIG. 9 is a front view of a display of an example game according to the embodiment of FIG. 7;

DESCRIPTION

Figure 1:
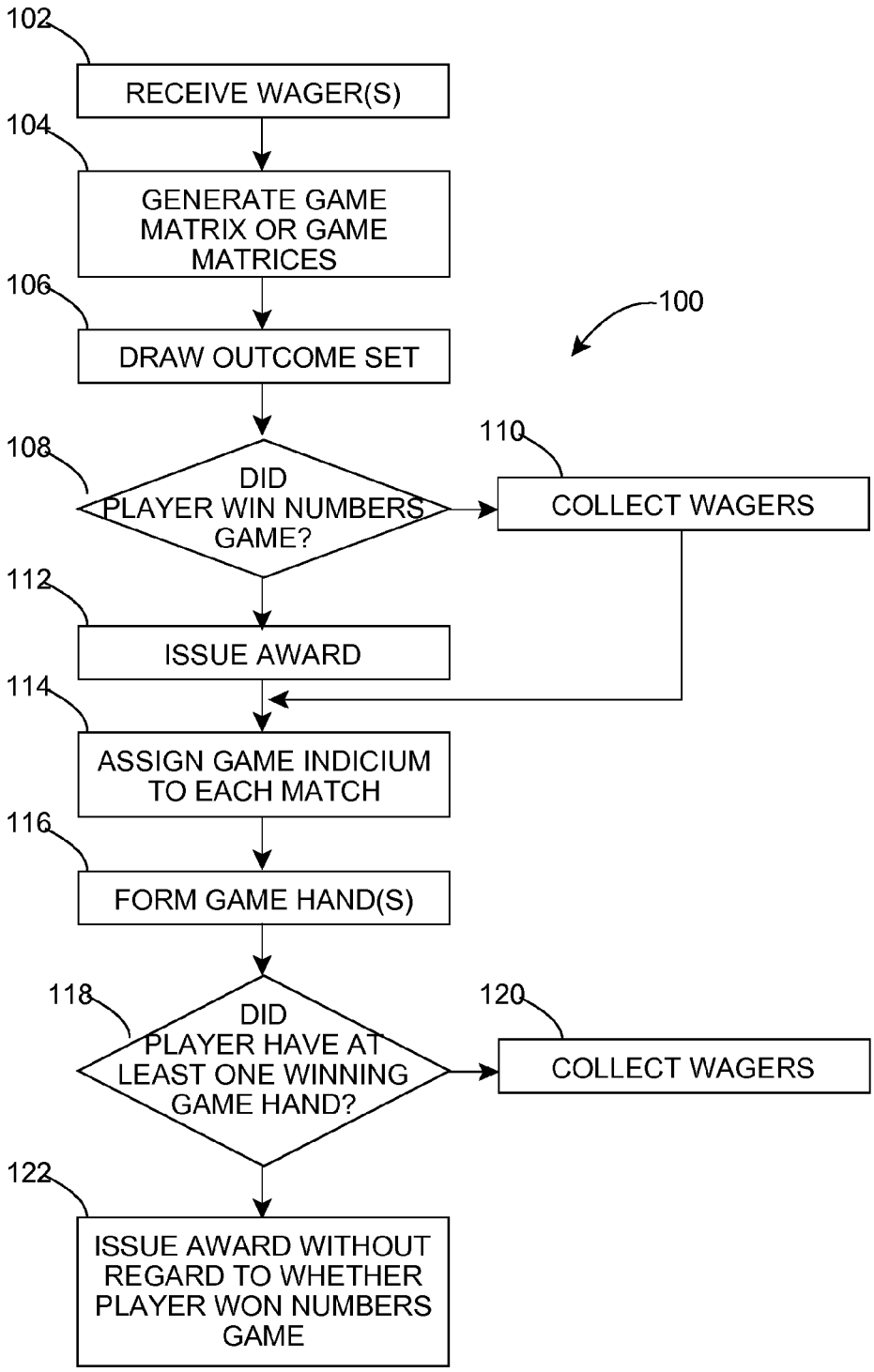
FIG. 1 is a flowchart of a method according to an embodiment of the present invention.

Reference is now made to the figures wherein like parts are referred to by like numerals throughout. Referring to FIG. 1, a method 100 according to the present invention is shown. In the optional embodiment illustrated, a method 100 of the present invention generally includes a numbers game component and a game hand component. A numbers game, is generally any game in which a player set of one or more numbers (whether selected by the player as in Keno or assigned to the player as in Bingo), an operator selects a quantity of numbers, and the player is rewarded for obtaining a certain quantity or pattern of matches. It is contemplated that the present invention could be conducted using any form of numbers game, including Bingo, Keno, or the like.

As can be appreciated, the present method could be conducted in a live version or in an electronic form. Moreover, as discussed in greater detail below, the electronic form could be in the form of any electronic device, including a video gaming machine, a general purpose computer, a server conducting a game over a computer network or the Internet, a cellular telephone, a PDA, a tablet device, a kiosk, a handheld device, or the like. In an optional embodiment in which each player has a separate device 200, the devices 200 may be enabled to communicate messages between or among players to maintain a social aspect of a game.

Figure 2:
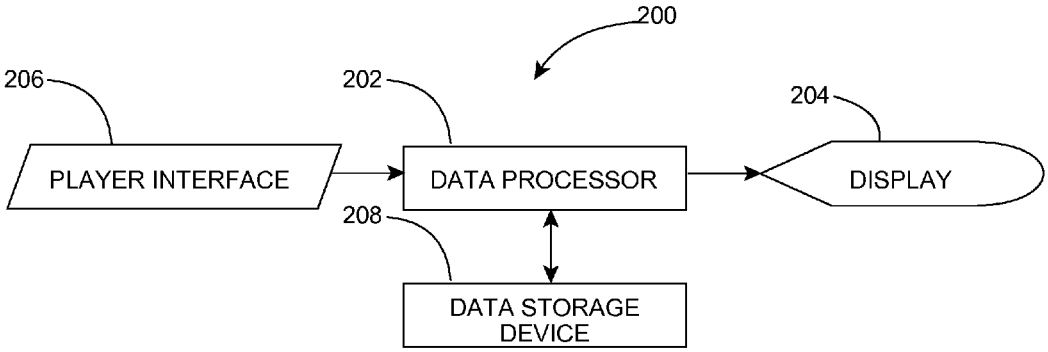
FIG. 2 is a block diagram of a device according to an embodiment of the present invention.
Figure 3:
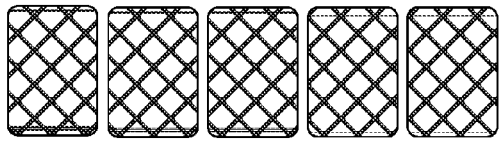
FIG. 3 is a front view of a display of an example game according to an embodiment of the present invention.
Figure 3:
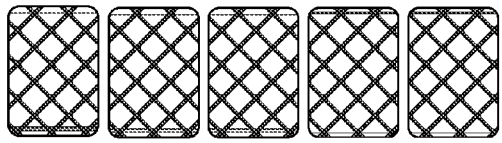
Figure 3:
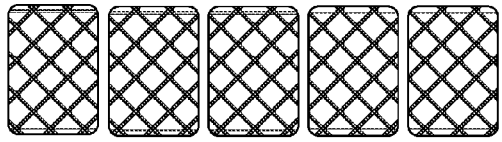
Figure 4:
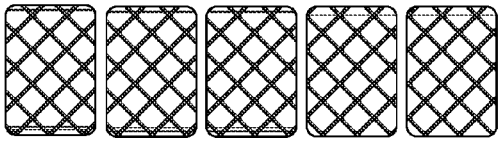
FIG. 4 is a front view of a display of an example game according to the embodiment of FIG. 3.
Figure 4:
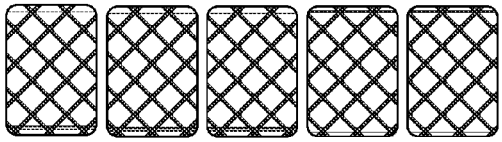
Figure 4:
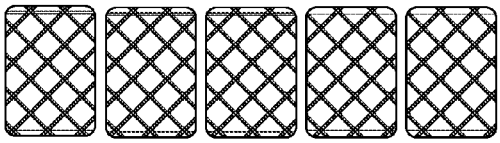

For example, in an optional embodiment illustrated in FIG. 2, a device 200 of the present invention may include a data processor 202, a display 204, a player interface, and a data storage device. It is contemplated that the various components of the present device could be remote from one another. For example, the data storage device 208 may be separate from the data processor, input device 206, and display 204, such as in an embodiment for a terminal or kiosk, or if the game is conducted over a computer network or the Internet.

The device 200 itself includes a data processor 202. The data processor 202 could take any form. The data processor 202 communicates with a display 204. The display 204 could be a cathode-ray tube monitor, a plasma screen, a liquid crystal display ("LCD"), organic light emitting diode ("OLED") display, or any other type of visually perceptible display. The data processor 202 also communicates with a player interface 206. The player interface 206 may include mechanical input devices, such as a button panel, keyboard, keypad, mouse, or other controller. In an optional embodiment, the player interface 206 may be combined with the display 204, such as in a touch screen device. The player interface may also include an output device for issuing payouts and/or cash outs to a player including a ticket or script printer, a coin or currency dispenser, a card encoder, a communications means for crediting a credit card or bank account, or the like.

The data processor 202 communicates with a data storage device 208. The data storage device 208 could be any form of data storage including optical, magnetic, flash, electrical, electronic, or other memory. The data storage device 208 stores game parameters, such as matrix templates, number indicia 302, 702, game indicia 304, 704, pay tables, game history records, or the like. Additionally, the data storage device 208 may store program instructions executable by the data processor 202 to conduct the game.

In one such optional embodiment, a game includes generating and displaying at least one game matrix 300, 700 at the display 204. The generating of the game matrix or game matrices 300, 700 may depend on the specific game. For example, in an optional embodiment based on Keno, the data processor 202 may receive input from the player through the player interface 206 to select one or more number indicia 702, e.g., Keno numbers, in a game matrix 700. In another example based on conventional Bingo, such as that illustrated in FIGS. 3-6, the game matrix 300 contains a fixed subset of the available number indicia 302 e.g., Bingo numbers, with no input received from the player prior to beginning the game. In a further or alternate optional example based on conventional Bingo, the game matrix 300 may be changed or regenerated if, for example, the player does not desire to play the game matrix 300 displayed. In a variation on Bingo, the data processor 202 may receive player input of some or all of the number indicia 302, e.g., Bingo numbers, to be included in the player's game matrix or game matrices 300, e.g., Bingo cards.

The data processor 202 conducts a numbers game component of a game in which the data processor 202 generates an outcome set by drawing number indicia 302, 702 and comparing the numbers drawn for the outcome set to the game matrix or game matrices 300, 700. In an optional embodiment directed to Keno, an outcome set containing a fixed quantity of number indicia 702 is drawn and the drawn number indicia 702 of the outcome set are compared to the number indicia 702 selected by the player. If the player obtained a threshold quantity of matches, the data processor 202 issues a reward to the player for a numbers game component of the game.

In an optional embodiment directed to Bingo, the drawn number indicia 302 are compared to the number indicia 302 displayed in the game matrix or game matrices 300. If a game matrix 300 includes a predetermined pattern of matches, the data processor 202 issues a reward to the player. Optionally, rewards may be displayed at the display 204 and/or issued to the player via the player interface 206.

In either case, the reward for the numbers game component could be enhanced or modified based on the number of matches, the number of patterns fulfilled, the total quantity of number indicia drawn to produce the matches or pattern(s) of matches, or the like. Similarly, it is contemplated that the reward for a numbers game component could be enhanced by randomly placed multipliers, bonus "balls" or bonus "numbers," or the like which result in an enhanced reward in the event that the player qualifies for a payout by obtaining the requisite quantity of matches or pattern of matches.

The data processor 202 conducts a game hand component of the game. In an optional embodiment, the data processor 202 assigns a game indicium 304, 704, e.g., a playing card, to each match. In an additional embodiment, the game hand component of the game is conducted after the numbers game component of a game and any matrix position within the game matrix 300 or game matrices that do not include a match, i.e., contain a number indicium 302 not drawn, may be assigned a game indicium 304, 704. That is, in one optional embodiment, game matrices 300 are filled in after completing the numbers game with randomly selected game indicia 304. In one optional embodiment, game matrices 300 are filled in with game indicia 304 randomly selected from game indicia 304 remaining in the inventory or deck of game indicia 304 after the numbers game component of the game is completed. Thus, in such an optional embodiment, previously assigned game indicia, whether or not they appear on the player's game matrix 300, are unavailable to be assigned during a stage in which matrix positions with unselected number indicia are randomly assigned game indicia.

In another optional embodiment, game indicia appearing in the game matrix 300 may be unavailable to be assigned, but any other game indicia may be available to be randomly placed into the game matrix 300. Thus, in such an optional embodiment, if a 5×5 game matrix 300 (having 25 total matrix locations) earned seven matches during a numbers game component of the game and, consequently, contains seven game indicia, game indicia used to fill in the remaining eighteen matrix locations during a game hand component of the game may exclude the seven game indicia already assigned but any other game indicia may be available to be assigned. For example, if the game indicia are conventional playing cards drawn from a conventional fifty-two card poker deck (although it is contemplated that other deck constitutions, such as Spanish decks, decks including one or more Jokers, or the like, could be used), the seven cards assigned during the numbers game may be "removed" from the deck, and the rest of the game matrix 300 may be filled in using cards randomly selected from the forty-five remaining in the deck after "removing" the seven previously-assigned cards.

In yet another optional embodiment, any game indicia may be assigned to the empty positions in the game matrix 300. In an example of such an optional embodiment, a full deck, rather than a deck with previously-dealt cards removed, may be used when randomly selecting cards for the "empty" positions in the game matrix 300. Stated differently, the previously-dealt game indicia (e.g., playing cards) may be reintroduced or added back into the set of game indicia (e.g., deck of playing cards) from which the "empty" game matrix 300 positions are filled. One practical effect of this is that cards dealt to the empty positions in the game matrix 300 may duplicate cards previously assigned during a numbers game component of a game.

In yet another optional embodiment, the game indicia available to be assigned may be defined based on the geometry of the game matrix 300. For example, in an optional embodiment in which game indicia are collected into defined sets, the game matrix 300 may be filled in using a separate set for each row, column, or other grouping within the game matrix 300. In one such example, the game indicia are conventional playing cards grouped into conventional fifty-two decks (although it is contemplated that other deck constitutions, such as Spanish decks, decks including one or more Jokers, or the like, may be used). In one such optional embodiment, a separate deck may be used for each row, column, or other defined subset in the game matrix 300. It is contemplated that previously-dealt cards within a subset of game matrix 300 positions may be removed from the deck used to fill in the empty positions in that subset of the game matrix 300. For example, if a row already contains an ace of hearts, the ace of hearts may be removed from the deck used to fill in the empty positions in that row. In this manner, the deck used for each grouping of empty positions may be different. In another example, the same deck may be used to fill in each grouping of empty positions. The deck used for each grouping could be a full deck (e.g., previously-dealt cards may be reintroduced or added to the deck) or a deck in which all previously-dealt cards are removed regardless of whether the previously dealt card was dealt to that subgroup of game matrix 300 positions.

The game indicia 304, 704 are grouped into one or more game hands 400, 800. For example, in an optional embodiment based on Bingo, game hands 400 may be formed based on the game indicia 304 assigned to patterns of matches within the game matrices 300. In one such example, the game matrix is a rectangular or square pattern of matrix positions containing number indicia 302. In one such example, a pattern of matches along a horizontal row, vertical column, diagonal, and/or four corners of the game matrix 300 is both a predetermined pattern that results in an award for the numbers component of the game but also defines a game hand 400 for the player.

In an optional example based on Keno, a game hand 800 may be formed from the game indicia 704 assigned to matches between the game matrix 700 and the drawn number indicia 702. In one optional embodiment, formation of the game hand 800 could be performed by the player through the player interface 206 or for the player by the data processor 202. Additionally, in an optional embodiment, the player may have the option to discard and replace zero or more cards from the game hand 800 by using the input device 206. An optional embodiment of such a method is described in greater detail below.

Optionally, each game hand 400, 800 is displayed at the display 204 and the data processor 202 determines whether each game hand 400, 800 is a winning hand. As explained in greater detail below, the data processor 202 may compare each game hand 400, 800 to a schedule of hands to determine whether the game hand 400, 800 is a winning hand, or may compare each game hand 400, 800 to game hands 400, 800 at other devices 200 (e.g., game hands 400, 800 of other players), or may compare each game hand 400, 800 to a dealer hand. If the data processor 202 determines that the game hand 400, 800 is a winning hand, the data processor 202 issues a reward to the player, optionally via the player interface 206. In an optional embodiment, a reward may be issued to a player for his or her game hand(s) 400, 800 independent of, and without regard to whether, the player also received an award for the numbers game component of the game.

As discussed in greater detail below, the data processor 202 may execute instructions to utilize multiple game matrices 300, 700 for each player. In one such optional embodiment, multiple game matrices 300, 700 at the display 204. In an optional embodiment directed to Keno, the data processor 202 may receive selections from the player for each game matrix 700 through the player interface 206. In an optional embodiment directed to Bingo, the data processor 202 may generate multiple game matrices 300, e.g., Bingo cards.

In a version of the game based on Keno, a game indicium 704 is assigned to each match between a number indicium 702 drawn to a selection set and a number indicium 702 selected by the player. In a Bingo version of the game, a game indicium 304 is assigned to each match between a number indicium 302 drawn to an outcome set and a number indicium 302 assigned to a game matrix 300 held by the player.

The game indicia 304, 704 are grouped into at least one game hand 400, 800. In an optional embodiment, separate game hands 400, 800 are formed by the data processor 202 for each game matrix 300, 700. For example, if five game matrices 300, 700 are used in the numbers game component of the game, up to five game hands 400, 800 may be formed for the game hand component of a game. In an optional embodiment based on Keno, a game hand 800 may be formed for each game matrix 700 based on selections by the data processor 202 and/or selections received through the player interface 206 of game indicia 704 appearing in each game matrix 700. In an optional embodiment based on Bingo, a game hand 400 may be formed for each game matrix 300 based game indicia 304 within on patterns of matches, such as rows, columns, diagonals, four-corners, or the like, in the game matrix 300.

Each game hand 400, 800 may be resolved separately, e.g., each game hand 400, 800 is compared to a standard such as a pay table, game hand(s) of other players, and/or dealer hand (s), or resolved together, e.g., the game hands are compared as a group to a standard. In yet another optional embodiment, a single game hand is selected from the multiple game hands, such as the best game hand, and that representative game hand is resolved against a pay table, another player's game hand, a dealer hand, or the like.

A method 100 according to the present invention may be implemented in a live environment, such as a Bingo hall or Keno parlor, or on a device (an example of which was described above). The example provided above should be interpreted as illustrative, rather than limiting, and it should be understood that the variations and descriptions given below may be incorporated into the example device described above.

According to an optional embodiment of the present invention, the game matrix or game matrices 300, 700 are based on at least one matrix template containing a plurality of matrix positions. The matrix template may take any form or shape. In an optional embodiment based on Bingo, for example, the matrix template may be a 5×5 matrix. In an optional embodiment based on Keno, for example, the matrix template may be an 8×10 matrix.

Figure 10A:
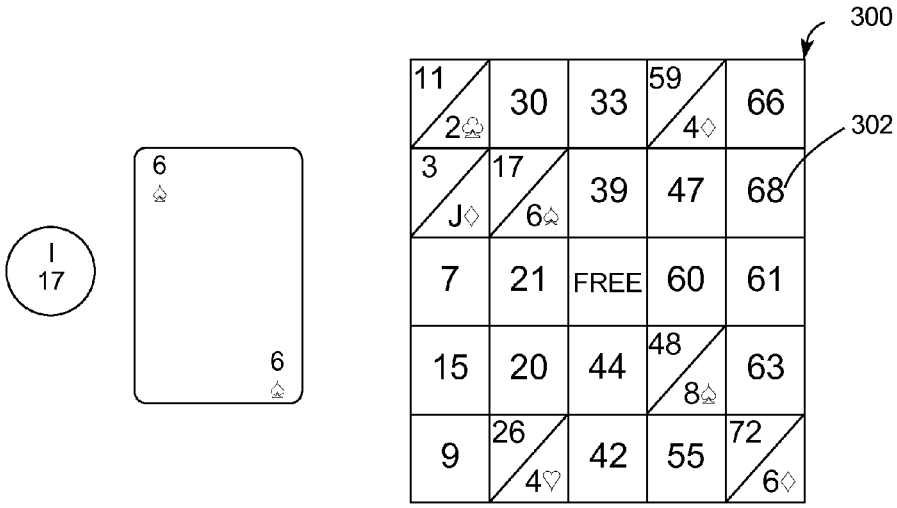
FIG. 10A is a front view of a display of an example game according to an embodiment of the present invention.
Figure 10B:
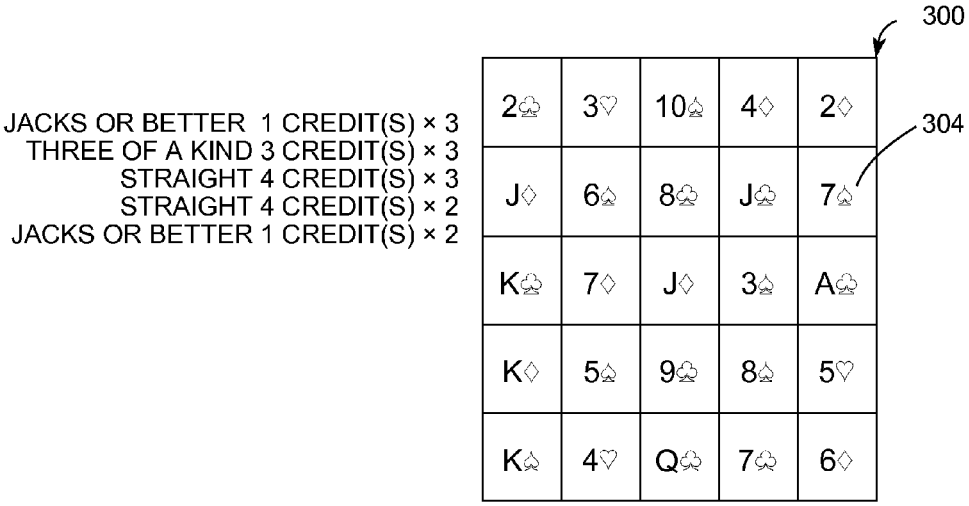
FIG. 10B is a front view of a display of an example according to the embodiment of FIG. 10A.

At least one wager is received 102. In an optional embodiment, at least one wager is received for the numbers component of the game and at least one wager is received for the game hand component of the game. In a further optional embodiment in which each player is provided multiple game matrices 300, 700 and/or multiple game hands 400, 800, multiple wagers for the numbers game component and/or multiple wagers for the game hand component may be received. In one example, a separate wager is required for each game matrix 300, 700 and each game hand 400, 800 generated. For example, if a player is provided five game matrices 300, 700 and may generate five game hands 400, 800, the player may be required to place ten wagers or allocate a wager to ten separate outcomes, i.e., one allocation per game matrix outcome and game hand outcome. Similarly, as illustrated in FIGS. 10A and 10B, a single game matrix may be provided, but multiple (twelve, in the example of FIGS. 10A and 10B) game hands are produced in each game. In such an optional embodiment the player may place a single wager for all game hands, or a separate wager for each game hand. In this regard, it is contemplated that the player may be required to wager on and activate all game hands in a game matrix 300 or may be permitted to separately wager on, and activate, individual game hands in a game matrix 300. For example, in an optional embodiment with twelve game hands (five rows, five columns, and two diagonals), the player may be enabled to wager on and activate only the five game hands resulting from the five rows. In the event that one of the columns contains a winning game hand, the player may be precluded from receiving a reward insofar as the player chose to forego activating the columnar game hands.

It is contemplated that the wagers may be any size. Specifically, it is contemplated that the player may be required to place wagers of equal size or that the player may be allowed to vary the size of wagers. Similarly, it is contemplated that the game matrix wager(s) and game hand wager(s) may be subject to the same wagering limits or different limits.

In using the term "wager," it is contemplated that the "wager" may be real or virtual. That is, in a wagering game environment, the wager may represent real money. Conversely, in an entertainment environment, the wager may represent fictitious money. In a hybrid environment, the wager may be fictitious insofar as the wager is not actually staked on the outcome of the game, but rather represents a fee or subscription for eligibility to play the game. Such fees may take any form, including virtual chips, tokens, or the like. While the operation of such fee-based games varies from embodiment to embodiment, in a typical embodiment, a user purchases tokens using real money. The tokens may be "wagered" in a game. Token games that pay rewards typically pay rewards in the form of tokens which may be used for "wagers" in subsequent games, but cannot be "cashed out" for real money. When the player runs out of tokens, the player cannot play the game unless the player purchases more tokens. Thus, tokens are only good for game play and, as such, do not represent true wagers which are staked on the outcome of the game and can result in a reward, but do represent wagers insofar as the tokens are usable to initiate a game and may be earned or bought for additional play of a game.

The game matrix or game matrices 300, 700 used in the game are generated 104 by filling a matrix template with number indicia 302, 702 at some, or all, of the matrix positions. Although the optional embodiment shown uses numbers to identify coordinates, it is contemplated that any symbol, designation, picture, character, or the like could be used to identify coordinates.

For example, in an optional embodiment based on Bingo illustrated in FIGS. 3-6, each game matrix 300 includes twenty-five number indicia 302, or twenty-four number indicia 302 plus a "FREE" space, filling the twenty-five matrix positions of the 5×5 matrix. In alternate optional embodiments, a "FREE" space may be omitted, with a number indicium placed in the center location of the game matrix 300. In an optional embodiment based on Bingo, game matrices 300 are generated by the data processor 202 randomly selecting number indicia 302 and placing the number indicia 302 in a matrix template based on a convention that limits the first, or "B," column to number indicia 1-15, the second, or "I," column to number indicia 16-30, the third, or "N," column to number indicia 31-45, the fourth, or "G," column to number indicia 46-60, and the fifth, or "O," column to number indicia 61-75. In another optional embodiment, the data processor 202 may receive selections through a player interface 206 of one or more number indicia 302 to include in the game matrix or game matrices 300, 700. Thus, in one such example, the player may be enabled to select at least some of the Bingo numbers to include in the player's Bingo card. In a further example, the player may be enabled to select the locations of the Bingo numbers in the player's Bingo card.

Figure 7:
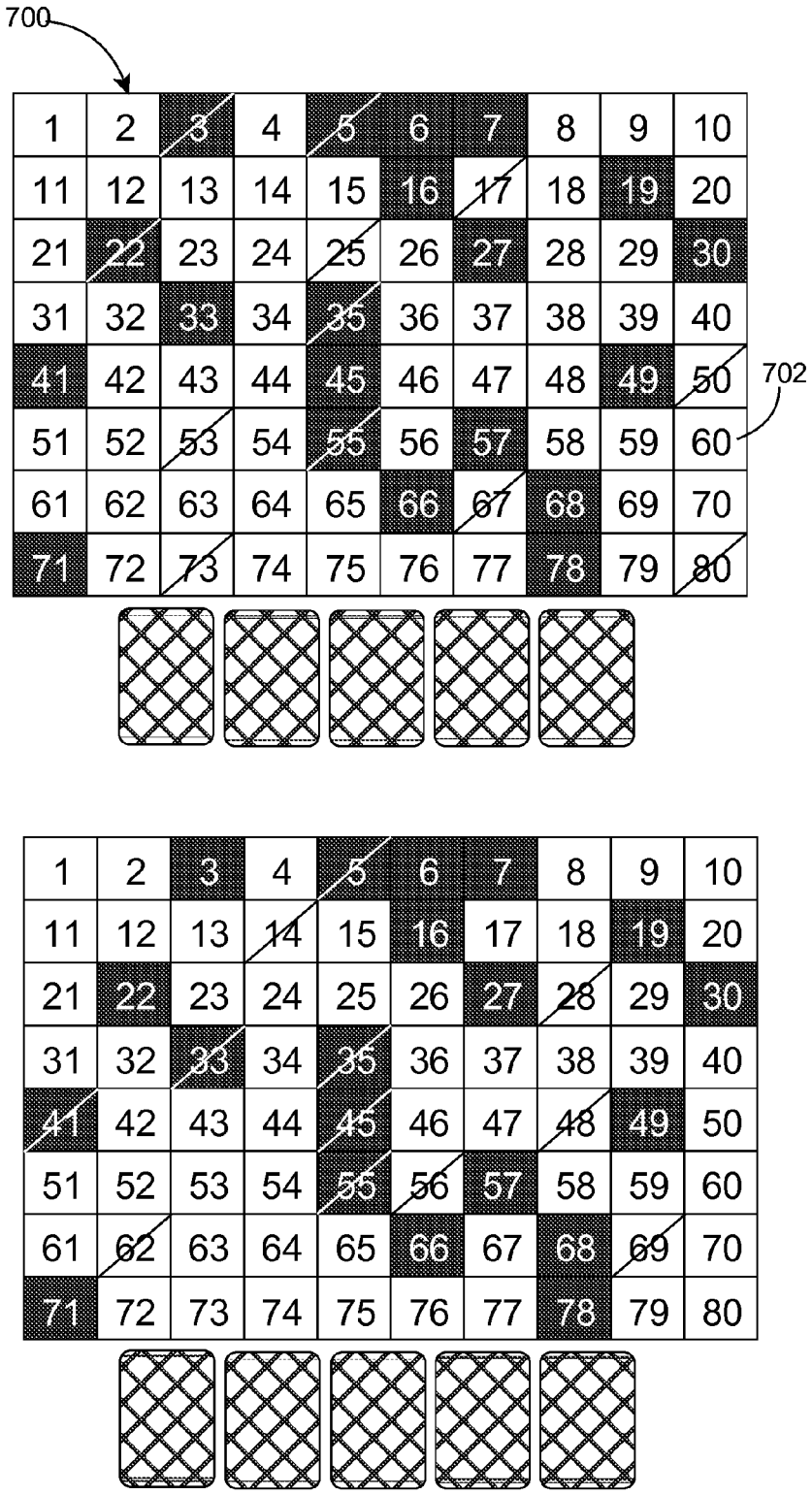
FIG. 7 is a front view of a display of an example game according an embodiment of the present invention.
Figure 8:
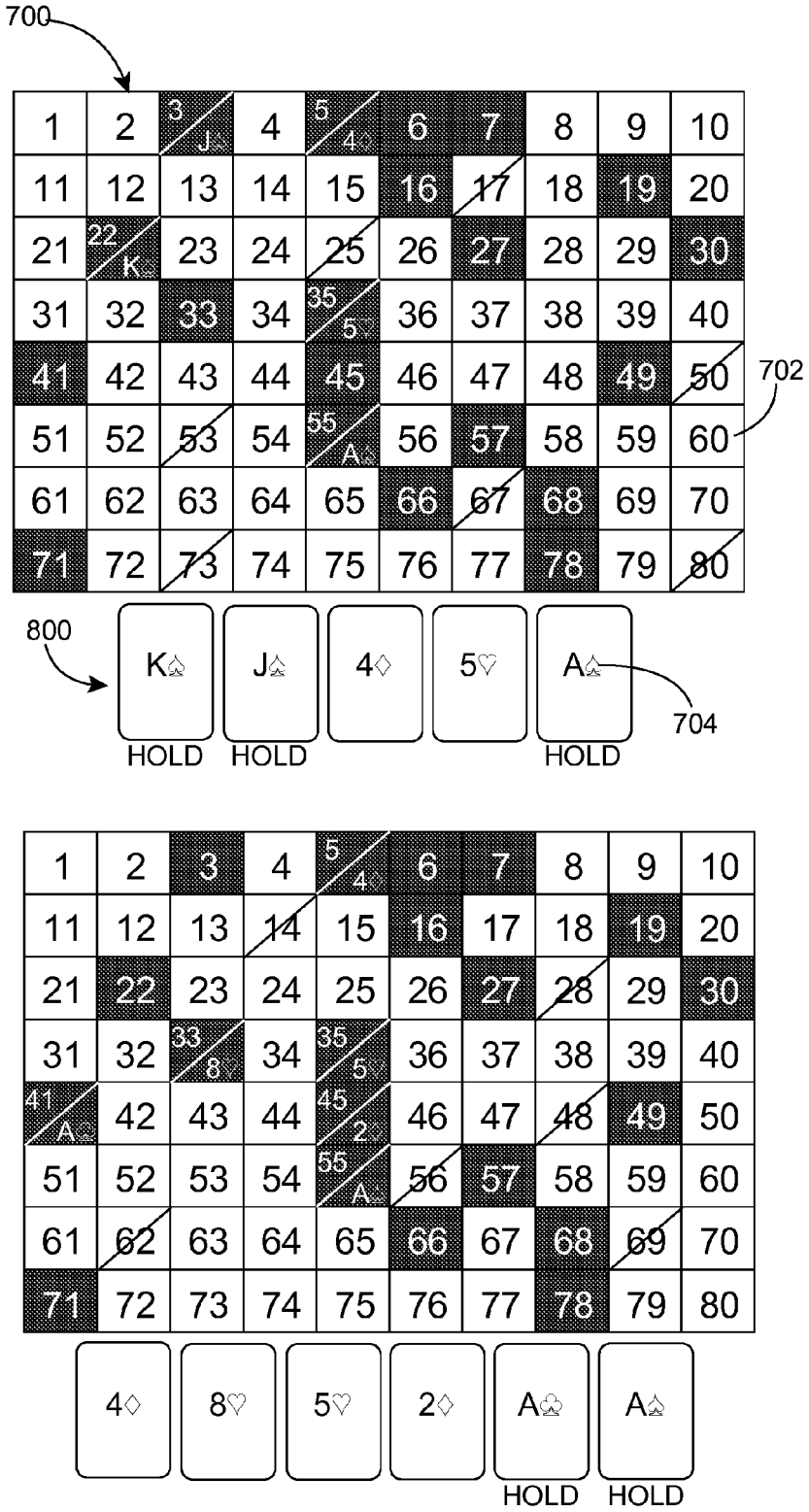
FIG. 8 is a front view of a display of an example game according to the embodiment of FIG. 7.

In an optional embodiment based on Keno illustrated in FIGS. 7-9, the game matrix 700 is fixed and contains the number indicia 1-80 arranged in eight rows of ten. In Keno the player inputs a selection set of number indicia 702 and, thus, may form different game matrices by selecting different number indicia 702 on the fixed Keno matrices, e.g., as illustrated in FIG. 7 a player could select 3-5-17-22-25-35-50-53-55-67-73-80 on one Keno matrix and 5-14-28-33-35-41-45-48-55-56-62-69 on another Keno matrix, thereby creating Keno matrices with different selection sets. It is noted that the present method does not necessarily require the player to select a specific quantity of number indicia 702. It is contemplated that this could be handled in a variety of ways. In one optional embodiment, the quantity of number indicia 702 selected by the player could be controlled by the underlying numbers game. Thus, a player may select any quantity allowed by the numbers game. In an alternate optional embodiment, the player may be required to select a minimum quantity of number indicia 702. In yet another optional embodiment, the player may be restricted from selecting more than a maximum quantity of number indicia 702. In another optional embodiment, the player may be allowed to select any quantity of number indicia 702 between a designated minimum and a designated maximum.

As noted above, it is contemplated that, in an optional embodiment, a plurality of game matrices 300, 700 may be generated for, or by, a player. In such an optional embodiment, each game matrix 300, 700 could be the basis of a separate and independent game in both the numbers game component and the game hand component of a game. In such an optional embodiment, a separate wager may be placed for each game matrix 300, 700 with each separate wager resolved using a different game matrix 300, 700 in a numbers game component of a game, and a separate game hand 400, 800 may be formed for each game matrix 300, 700 for a game hand component of a game, in a manner described in greater detail below.

Returning to FIG. 1, a method 100 includes randomly selecting 104 an outcome set containing a quantity of number indicia 302, 702. In a version based on Keno, a predetermined quantity of number indicia 702 is selected. While the predetermined quantity may be any quantity and, in fact, could vary from game to game, in an optional embodiment, twenty number indicia 702 are randomly drawn for each game.

In a Bingo version, the quantity of drawn number indicia 302 may be indefinite in that number indicia 302 are drawn and matches identified in players' game matrices 300 (e.g., Bingo cards) until a predetermined pattern of matches is formed on at least one of the game matrices 300 (e.g., a player obtains a "Bingo" outcome). In another optional embodiment, a fixed quantity of number indicia 302 (e.g., Bingo numbers) may be randomly selected independent of whether a predetermined pattern of matches is, or is not, formed on one or more player's game matrix or game matrices 300. In yet another optional embodiment, number indicia 302 may be drawn until the player's game matrix or a competitor's matrix obtains a predetermined pattern of matches. It is noted that the competitors may be live competitors (e.g., other live players), the game operator, virtual competitors (e.g., game matrices 300 assigned to the data processor to create a pool of competitors), or a mixture thereof. For example, in an optional embodiment, a numbers game may be configured as a social game against other live competitors such that number indicia are drawn until at least one game matrix 300 among the competitors contains a predetermined pattern. In an optional embodiment, if fewer than a predefined quantity of live competitors participate, virtual competitors may be included to fill in any empty slots. In another example, a single-player game may be conducted in which all the competitors are virtual competitors.

Turning back to FIG. 1, matches between the outcome set of number indicia 302, 702 and the number indicia 302, 702 of the player's game matrix or game matrices are identified and a determination is made whether the matches create a winning outcome 108 in the numbers game component of the game. In a game based on Keno, the determination is made by determining if the matches between the randomly selected number indicia 702 and the player-selected number indicia 702 on any one game matrix 700 exceeds a threshold. Put another way, the number indicia 702 selected by the player are compared to the number indicia 702 drawn to the outcome set. The quantity of matches are counted and compared to a threshold. The threshold may be any quantity, but in an optional embodiment, the threshold is determined by the underlying game. For example, in Keno, the threshold is typically 50% of the number indicia 702 selected; that is, a player must typically obtain matches in more than half the number indicia 702 selected to obtain a reward. Thus, if a Keno player selects seven numbers, a typical Keno paytable requires the player to match four or more drawn numbers to obtain a reward. It is also noted for the sake of clarity that a player who matches a selected number with a drawn number is said to have a "catch."

In an embodiment based on Bingo, the determination for a numbers game component is made based on the pattern of matches in the player's game matrix or game matrices 300. Specifically, the matches between the randomly selected number indicia 302 in the outcome set and the number indicia 302 of the player's game matrix or game matrices 300 are identified and if the locations of those matches within the player's game matrix or game matrices 300 form a predetermined pattern of matches, the player is entitled to an award for a numbers game component. The predetermined pattern or patterns of matches may vary depending on the embodiment. For example, as discussed above, the game matrices 300 may be rectangular or square with number indicia 302 arranged in rows and columns. In one such optional embodiment, predetermined patterns may include columns (vertically adjacent number indicia crossing the entire matrix), rows (horizontally adjacent number indicia crossing the entire matrix), diagonals (adjacent number indicia crossing from one corner to a diagonal corner of the entire matrix), four-corners, cover-all (all number indicia within the matrix), or the like.

The numbers game component of the game is resolved. Specifically, a determination is made whether the player's wager(s) for the numbers game component are rewarded 112 or collected 110. As suggested above, in a game with multiple game matrices 300, 700, a separate wager may be associated with each game matrix 300, 700. In such an optional embodiment, a wager may be rewarded or collected based on the game matrix 300, 700 associated with that player wager.

In an embodiment based on Bingo, for example, if a game matrix 300 includes a predetermined pattern of matches, the player's wager associated with that game matrix 300 may be rewarded. Conversely, if a game matrix 300 does not include a predetermined pattern of matches, the player's wager associated with that game matrix 300 may be collected. As noted above, one optional embodiment may include one or more of rows, columns, diagonals, four-corners, cover-all, or the like as the predetermined pattern(s).

In an optional embodiment based on Keno, if the quantity of matches for a game matrix 700 meets or exceeds the threshold, the player is rewarded for a numbers game component. Conversely, if the player has less than a threshold quantity of matches, the player is not rewarded and the wager associated with that game matrix 700 for a numbers game component is collected.

The reward may vary based on a number of factors. For example, in Bingo, the reward may depend on the pattern filled, whether the pattern included a "FREE" space, the quantity of patterns filled, or the like. Similarly, in Keno, the reward may depend upon the quantity of number indicia selected by the player for the game matrix 700 and the quantity of matches between the numbers selected and the numbers drawn. Thus, a player catching six out of twelve may have his wager returned whereas a player catching ten out of twelve would likely receive a much higher payout. In either case, the reward may additionally depend on the quantity of game matrices 300, 700 eligible for a reward. For example, a player may receive a greater reward or a bonus for having multiple winning game matrices 300, 700 than for having a single winning game matrix 300, 700. Bonus payouts may also be paid based on the game matrices 300, 700 as described in greater detail below.

The present method 10 also includes a game hand component. Game hands 400, 800 are formed using game indicia 304, 704. Game indicia 304, 704 may take any form, including playing cards, slot reel symbols, pai gow tiles, mah jong tiles, dice faces, roulette numbers, or the like. In an optional embodiment, game indicia 304, 704 may be constituted into a deck or other set. For example, in an optional embodiment, a deck may be a conventional fifty-two card deck. In a further optional embodiment, the deck may be supplemented with jokers, non-playable bonus cards, or other additional cards. However, it is contemplated that any deck constitution may be defined, including one or more conventional decks, one or more truncated decks (such as Spanish decks), one or more supplemented decks (such as decks including jokers or blank cards, multiplier cards, or other non-playable bonus cards), or any other constitution.

According to the present method 100, each match on a game matrix 300, 700 is assigned 114 a game indicium. The assignment may take any form, including random assignment. In one optional embodiment, each match may be assigned a unique game indicium 304, 704, as if game indicia 304, 704 are dealt from a deck so that a game indicium 304, 704 does not reappear once it is dealt from the deck. For example, in an optional embodiment in which the game indicia 304 are playing cards, if the number indicium B-14 is matched on a player's game matrix 300, and the match is assigned the game indicium 4♢, the 4♢ is removed from the "deck" of game indicia 304 available for assignment and cannot be subsequently assigned in the same game.

In another optional embodiment, a game indicium 304, 704 may be assigned to all matches for the same number indicium 302, 702, regardless of the player or game matrix 300, 700 on which the number indicium appears. In the example above, any game matrix 300 for any player with a match for the number indicium B-14 is assigned the game indicium 4♢.

In yet another optional embodiment, a game indicium 304, 704 may be assigned to all matches for the same number indicium 302, 702 for a particular player, but a different random assignment may occur for each separate player. In the example above, a first player having a game matrix 300 with a match for the number indicium B-14 may be assigned the game indicium 4♢ for that match, but a second player having a game matrix 300 with a match for the number indicium B-14 may receive a different random assignment of a game indicium 304, such as K♤, for the match.

In yet another optional embodiment, game matrices 300, 700 may be grouped across players and a match for a particular number indicium 302, 702 within the group of game matrices 300, 700 may correspond to the same game indicium 304, 704 regardless of player. For example, in an optional embodiment, each player may have three game matrices numbered one through three. If the number indicium B-14 is selected, it may correspond to the game indicium 4♢ for any matches on game matrix one, K♤, for any matches on game matrix two, and 10♡ for any matches on game matrix three for all of the players.

In yet another optional embodiment, the present method 10 could be conducted with repeated assignment of game indicia 304, 704 allowed. Thus, in such an optional embodiment, 40 could be assigned repeatedly in the same game as if multiple playing card decks are used or as if cards were being returned to a deck as they were dealt. For example, matches for the number indicium B-14 could correspond to 4♢ and a later match for the number indicium G-53 in the same game could also correspond to 4♢.

It is contemplated that the process of assignment of game indicia 304, 704 to matches may optionally occur simultaneous with the drawing of number indicia 302, 702. Alternatively, the assignments may optionally occur after the number indicia 302, 702 have been drawn.

In an optional embodiment based on Bingo as illustrated in FIGS. 3-6, the game indicia 304 corresponding to matches may be positioned in the game matrix 300 at the matrix position where the match occurred. For example, if a game matrix includes the number indicium B-5 in the first column, third row, and a random selection correlates the match to the game indicium A♧, the A♧ game indicium may be positioned to appear with or over the number indicium B-5.

In an optional embodiment based on Keno illustrated in FIGS. 7-9, if a drawn number indicium 702 matches a number selected by the player, a game indicium 704 assigned to the match is added to a player set. Thus, for example, if the player selects "46" and "46" is randomly drawn in the numbers game component of the game, i.e., during the Keno game, a match occurs. If that match is assigned 8♤, the game indicium 8♤, is added to the player set. In an optional embodiment, the player set may consist of the game indicia 704 available to the player for forming a game hand 800, as discussed in greater detail below. It is noted that the player set could be of any size since the number of game indicia 704 within the player set depends on the quantity of matches in the number game component of the game.

At least one game hand 400, 800 is formed 116 from game indicia 304, 704 corresponding to matches in a player's game matrix or game matrices 300, 700. The game hands 400, 800 may be formed automatically, such as by a data processor 202, or may include an element of player selection, such as through a player interface 206, or may be a combination of both. The size and composition of the player hand 400, 800 depend upon the rules of the underlying game hand component. The underlying game hand component could take any form including Poker, Blackjack, Pai Gow Poker, Pai Gow, or any other gambling game using game indicia 304, 704.

In an optional embodiment based on Bingo, game hands 400 may be formed based on predetermined patterns of matches in the game matrix or game matrices 300 (e.g., Bingo cards) of a player. For example, as illustrated in the example of FIGS. 3-6, a player may have a matches for the number indicia B-14, I-22, N-35, G-56, O-68 which correspond to the game indicia 5♡ 5♧ 8♧ Q♡ Q♢. In this example, the row containing the matches may be treated as a predetermined pattern and, thus, a game hand 400 from this game matrix 300 would be 5♡ 5♧ 8♧ Q♡ Q♢. In an optional embodiment based on Bingo, in the event that multiple predetermined patterns of matches are formed on a game matrix 300, the player may be limited to one of the game hands 400 (such as the highest ranking game hand among the possible game hands that could be formed), or the player may be permitted to use all game hands 400 that may be formed, or the player may be limited to a particular game hand 400 based on the player's selection (e.g., the player may be limited to a single game hand 400, but may have discretion to choose which of the game hands 400 to use).

In one optional embodiment based on Keno, for each drawn number indicium 702 that matches a selected number indicium 702, the assigned game indicium 704 is added to the player set or set associated with each game matrix 700 on which the selected number indicium 702 appears. In the example of FIGS. 7-9, the player-selected number indicia 3, 5, 22, 35, and 55, were matched by drawn number indicia 702 and the matches were assigned 4♢ 5♡ J♤ K♤ A♤. Thus, the game hand resulting from the matches is 4♢ 5♡ J♤ K♤ A♤. In an optional embodiment in which the quantity of matches and the resulting quantity of game indicia 704 available exceeds the quantity of game indicia 704 needed to form a game hand, the game indicia 704 for the game hand may be selected automatically, such as by a data processor 202, selected by the player, such as through a player interface 206, or a combination of automatic and player selection. For example, if the player obtains sis matches in the numbers game component but only needs five game indicia 704 to form a game hand, the five game indicia 704 for the game hand may be selected for the player, by the player, or a combination thereof. In further or alternate optional embodiments, game hands may be formed through any game indicia associated with a match in the outcome set by assigning game indicia, e.g., playing cards, to a game hand randomly, partially randomly, or non-randomly.

In an optional embodiment in which multiple game matrices 300, 700 are provided to a player, each game matrices 300, 700 may result in a separate game hand 400, 800, if it is possible to form a game hand 400, 800 for the game matrix 300, 700. For example, a player could conduct five game matrices 300, 700 which could result in up to five game hands 400, 800. In one such example game, the player may form a game hand 400, 800 for each game matrix 300, 700 resulting in five game hands 400, 800. In another example game, the player may form a game hand 400, 800 for fewer than each game matrix 300, 700 because some of the game matrices 300, 700 lack sufficient game indicia 304, 704 to form a game hand 400, 800. In another optional embodiment, the player may be guaranteed or nearly guaranteed to form a game hand 400, 800 for each game matrix 300, 700, such as by drawing a sufficient quantity of number indicia 302, 702 that each game matrix 300, 700 is certain to contain, or has a high statistical probability of containing, a sufficient number of matches to form a game hand 400, 800.

It is noted that a game hand 400, 800 could be defined to include any number of game indicia 304, 704 depending on the game hand component of the game. For example, if the game hand component is based on five-card draw poker, each game hand 400, 800 may contain five game indicia 304, 704. Other games, such as seven-card stud (seven cards), Pai Gow Poker (seven cards), Pai Gow (four tiles), five card stud (five cards), Three Card Poker (three cards), may require a different quantity of game indicia 304, 704 for each game hand 400, 800.

In an optional embodiment, the game hands 400, 800 may require further processing and/or input before forming a final game hand for resolution of the game hand component of the game. For example, in an optional embodiment based on Pai Gow or Pai Gow Poker, component hands (often referred to as a front hand and a back hand, or a high hand and a second high hand) may be identified within the game hand. For example, in Pai Gow Poker, a game hand includes seven game indicia 304, 704 which are separated into a two-card front hand and a five-card back hand. It is contemplated that, as applied to an embodiment of the present invention, the designation of a front hand and a back hand may be performed by a data processor 202, by a player through a player interface 206, or a combination thereof.

In another example based on five-card draw poker, zero or more game indicia 304, 704 within a game hand 400, 800 may be designated to be discarded from the game hand 400, 800 and replaced. In one such optional embodiment, the player selects game indicia 304, 704 for discard through a player interface 206. The data processor 202 removes the discarded game indicia 304, 704 from the game hand 400, 800 and randomly selects replacement game indicia 304, 704 to be added to the game hand 400, 800. In one optional embodiment, all the game indicia 304, 704 assigned to matches within a game matrix 300, 700 are treated as if dealt from a deck, and the replacement game indicia 304, 704 are dealt from a deck excluding the game indicia 304, 704 already assigned within the game matrix 300, 700 regardless of whether those game indicia 304, 704 appear in the game hand 400, 800. For example, as illustrated in FIGS. 3-6*m* if matches within a game matrix 300 are assigned 3♠ 4♢ 5♡ 5♣ 8♣ J♣ Q♡ Q♢, but only the game indicia 5♡ 5♣ 8♣ Q♡ Q♢ fall in a predetermined pattern eligible to form a game hand 400, the replacements may be dealt from a deck excluding the game indicia 3♠ 4♢ J♣ as well as the 5♡ 5♣ 8♣ Q♡ Q♢. If a deck is a single conventional poker deck, this means that replacement cards are dealt from the forty-four cards excluding the eight cards previously dealt. As may be appreciated, such a concept may be applied individually to each game matrix 300, 700, such that each game matrix 300, 700 is associated with a separate deck that is separately depleted through the game hand 400, 800 component for that game matrix 300, 700. Alternatively, such a concept may be applied across all game matrices 300, 700, such that a continuously depleted deck is used for all game matrices 300, 700. In this manner, a game indicia 304, 704 will not be reused, even in a different game matrix 300, 700 within the same game.

In another optional embodiment, the unused game indicia 304, 704 are returned to the deck used for replacements. Again, using the example above from FIGS. 3-6 in which matches within a game matrix 300 are assigned 3♠ 4♢ 5♡ 5♣ 8♣ J♣ Q♡ Q♢, but only the game indicia 5♡ 5♣ 8♣ Q♡ Q♢ fall in a predetermined pattern eligible to form a game hand 400, the replacements may be dealt from a deck excluding the game indicia 5♡ 5♣ 8♣ Q♡ Q♢ while the unused game indicia 3♠ 4♢ J♣ are added back to the deck, also referred to as "addition," "deck addition," or "card addition," and are thereby eligible to be dealt as replacement cards to the game hand 400. In yet another version of such an optional embodiment, discarded cards are also returned to the deck prior to dealing replacements through addition. In the example above, the selected game hand 400 may include 5♡ 5♣ 8♣ Q♡ Q♢. If the player chooses to discard 8♣, it is returned to the deck with the unused cards 3♠ 4♢ J♣ and all undealt cards. In this example, a single replacement card is dealt to the four held cards 5♡ 5♣ Q♡ Q♢ from a deck containing forty-eight cards (forty-four undealt cards plus three dealt, but unused, cards plus one dealt, but discarded, card).

It is contemplated that other types of game hand processing may occur through the game hand component of a game. For example, in an optional embodiment based on Texas Hold'em or other community card games, community game indicia may be randomly selected. The game hand 400, 800 of a player may be combined with the community game indicia to resolve the game hand component of a game. In one such example, community game indicia may be unique to a player but may be used in combination with game hands 400, 800 from any game matrix 300, 700 used by the player. In another such example, community game indicia may be universal to all players and for all game matrices 300, 700 in a game.

Game hands 400, 800 are examined to determine 118 whether the game hand 400, 800 is a winning hand. If a game hand 400, 800 is a winning hand, an award is issued. If a game hand 400, 800 is not a winning hand, the wager(s) are collected. Whether a game hand 400, 800 is a winning hand may be determined in a variety of ways. For example, in one optional embodiment, the game hand 400, 800 is compared to a pay table or other schedule of winning hands and the awards or payouts associated therewith. It is noted that the pay table could include any hands or hand rankings In the optional embodiment illustrated, the pay table includes conventional poker hands. In such an optional embodiment, each game hand 400, 800 is compared to a pay table and the award, if any, associated with the game hand 400, 800 is issued to the player. In an optional embodiment in which a player forms multiple game hands 400, 800, the player may be limited to comparing his or her highest game hand 400, 800 to the pay table, or may be allowed to compare multiple game hands 400, 800 (such as one game hand 400, 800 per game matrix 300, 700) to the pay table, or the like.

In an alternate optional embodiment, the game hand 400, 800 may be compared to another hand. For example, in one optional embodiment, a dealer hand may be randomly selected. Each game hand 400, 800 may be compared to the dealer hand and each game hand 400, 800 that outranks the dealer hand is deemed a winning hand and an award is issued. In optional embodiments in which a player forms multiple game hands 400, 800, the player may be limited to comparing his or her highest game hand 400, 800 to the dealer hand, or may be permitted to compare multiple game hands 400, 800 (such as one game hand 400, 800 per game matrix 300, 700) to the dealer hand, or the like.

In yet another optional embodiment, the game hand 400, 800 may be compared to game hands 400, 800 of other players. For example, in one such optional embodiment, a device may communicate with a server and/or to devices 200 controlled by other players. In one such optional embodiment, game hands 400, 800 may be compared inter se, i.e., among one another, to determine the highest ranking hand among the game hands 400, 800. For example, if twenty players form a game hand 400, 800, the twenty game hands 400, 800 may be compared to determine the highest ranking game hand 400, 800 and, thus, the player or players entitled to be issued an award. In optional embodiments in which a player forms multiple game hands 400, 800, the player may be limited to comparing his or her highest game hand 400, 800 to the other players' game hands 400, 800, or may be permitted to compare multiple game hands 400, 800 (such as one game hand 400, 800 per game matrix 300, 700) to the other players' game hands 400, 800, or the like. In another optional embodiment in which a player forms multiple game hands 400, 800, the game hands 400, 800 may be separately designated and compared according to designation. For example, if each player forms game hands A, B, C, D, and E, the players may compare their A game hands, inter se, to determine the winner of game A, compare their B game hands, inter se, to determine the winner of game B, compared their C game hands, inter se, to determine the winner of game C, and so forth. In this manner, there could be up to five winners for five game hands 400, 800, or certain players may win multiple game hands 400, 800. In any of these cases, a tie may be treated in many different ways. In one optional embodiment, the tie may be broken by examining the game hand 400, 800 and/or the game matrix 300, 700 associated with the game hand 400, 800. For example, in an embodiment in which the game hand 400, 800 may be altered by discarding and replacing game indicia 304, 704, the tie may be broken by examining the original game hand 400, 800 from the game matrix 300, 700 before any discarding and replacement occurred. In alternate optional embodiments, the tie may result in a dividing of the award between or among the tied players or a rollover of the award to the next subsequent game without a tie.

As noted above, it is contemplated that the award issued for having a winning game hand 400, 800 is optionally awarded without regard to whether the player received an award for the numbers game component of the game. That is, in such an optional embodiment, the game hand component and the numbers game component are resolved separately and independently such that the player may win none, either, or both of the components.

However, it is also contemplated that, in an optional embodiment, the size or type of reward issued to the player in either component may be affected by the results of the other component. For example, in one optional embodiment, if the player wins both the number game component and the game hand component, the player may be eligible for an enhanced award or an additional award in the form of a jackpot, progressive jackpot, bonus or secondary award, or the like. In a further optional embodiment, a player may be required to meet an additional criterion to receive a jackpot. For example, a player who wins the number game component and the game hand component may receive a reward if the winning game hand is formed using game indicia associated with selected numbers forming a predetermined geometric shape (such as a column, row, L-shape, four corners, or any other shape). In an additional or alternate optional embodiment, a criterion to win a jackpot, bonus, or progressive pay out may be the receipt of an extra wager for eligibility in the jackpot, bonus, or progressive pay out determination. If a player fails to place the extra wager, the player may be ineligible to receive the jackpot, bonus, or progressive pay out even if the player otherwise satisfies all the conditions for winning the pay out. In yet a further additional or alternate optional embodiment, the player may be presented with multiple jackpot, bonus, or progressive options, and the player may be enabled to select one or more options, for example, through a player interface.

Other jackpots or bonuses may likewise be awarded. For example, in one optional embodiment based on Bingo, a bonus may be awarded for obtaining certain predetermined patterns in a game matrix 300, 700. For example, in an optional embodiment, obtaining matches on the four corners of a game matrix 300, 700 could be used to trigger a bonus feature in which a random award, award multiplier, secondary game, or other bonus is issued to the player. For example, in an optional embodiment, the bonus feature could be displayed as a matrix position, such as a "FREE" square, that lifts or appears to lift off the game matrix and form a cube that displays the bonus won.

In another optional embodiment, the game matrices 300, 700 may be altered in some fashion to enhance the numbers game component or provide some bonus or bonus opportunity to the player. For example, in one optional embodiment, bonus spots may be placed matrix locations in some or all of a player's game matrices 300, 700 in random locations or in locations based on predetermined parameters. The placement of bonus spots may be triggered by a game event, such as a game outcome or other occurrence in the game, e.g., selection of a designated number indicia 302, 702, a match of a designated number indicia 302, 702, a match in a designated matrix location, a match in a designated pattern, or the like. Alternatively or additionally, placement of bonus spots may be triggered by non-game events, such as the duration of a player's session in games or time, quantity of games played, amount of awards won, amount wagered, quantity of specified game outcomes (such as Bingo outcomes, four-corners outcomes, or the like) accumulated over a session in games or time, or any other measure or estimate of game play.

In an additional or alternative optional embodiment, a bonus trigger may cause a second-screen or bonus screen feature in which a player selection may lead to a bonus pay out of a change in the underlying numbers game component or game hand component of the game. For example, in one optional embodiment, a player may be presented with a number of possible selections and a bonus pay out or game feature (such as free game matrices, payout multipliers, or the like) may be provided based on the selection input by the player.

In an optional embodiment, bonus features may affect the game hand component of a game. For example, in an optional embodiment, a bonus may be triggered from selection of a bonus number indicia 302, 702, selection of a bonus matrix position, match of a bonus number indicia 302, 702, match of a bonus pattern, or the like, and the bonus may result in the addition or availability of a wild game indicia 304, 704, blank game indicia 304, 704, or other game indicia 304, 704 with special attributes in a game hand (e.g., wild game indicia 304, 704 that can substitute for other game indicia 304, 704). In another optional embodiment, a triggered bonus may be an instant win for the player in which the player receives a pay out independent of whether the player has a winning numbers game outcome or game hand outcome.

In a further or alternate optional embodiment, a bonus feature may be triggered (optionally in a manner described above) and may cause the game indicia 304, 704 to appear in all the matrix positions of the game matrix as if all the number indicia 302, 702 in the game matrix 300, 700 had been matched by drawn number indicia 302, 702. That is, in a Bingo example, the Bingo card is marked as if it had obtained a cover-all, and playing cards may be assigned to each of the matches in the cover-all, based on the triggering of the bonus rather than the numbers in the Bingo card actually being called. In this manner, the player would have multiple predetermined patterns filled and be eligible to form multiple game hands 400, 800 in a game hand component of the game. In another aspect, the numbers game component may be bypassed either upon a bonus trigger or, optionally, at the election of the player. For example, in one such optional embodiment, the player may elect to bypass the numbers game component and merely have the game matrix or game matrices filled as if the numbers game outcome was a cover-all. The game hand component would then proceed substantially as described above.

Figure 16:
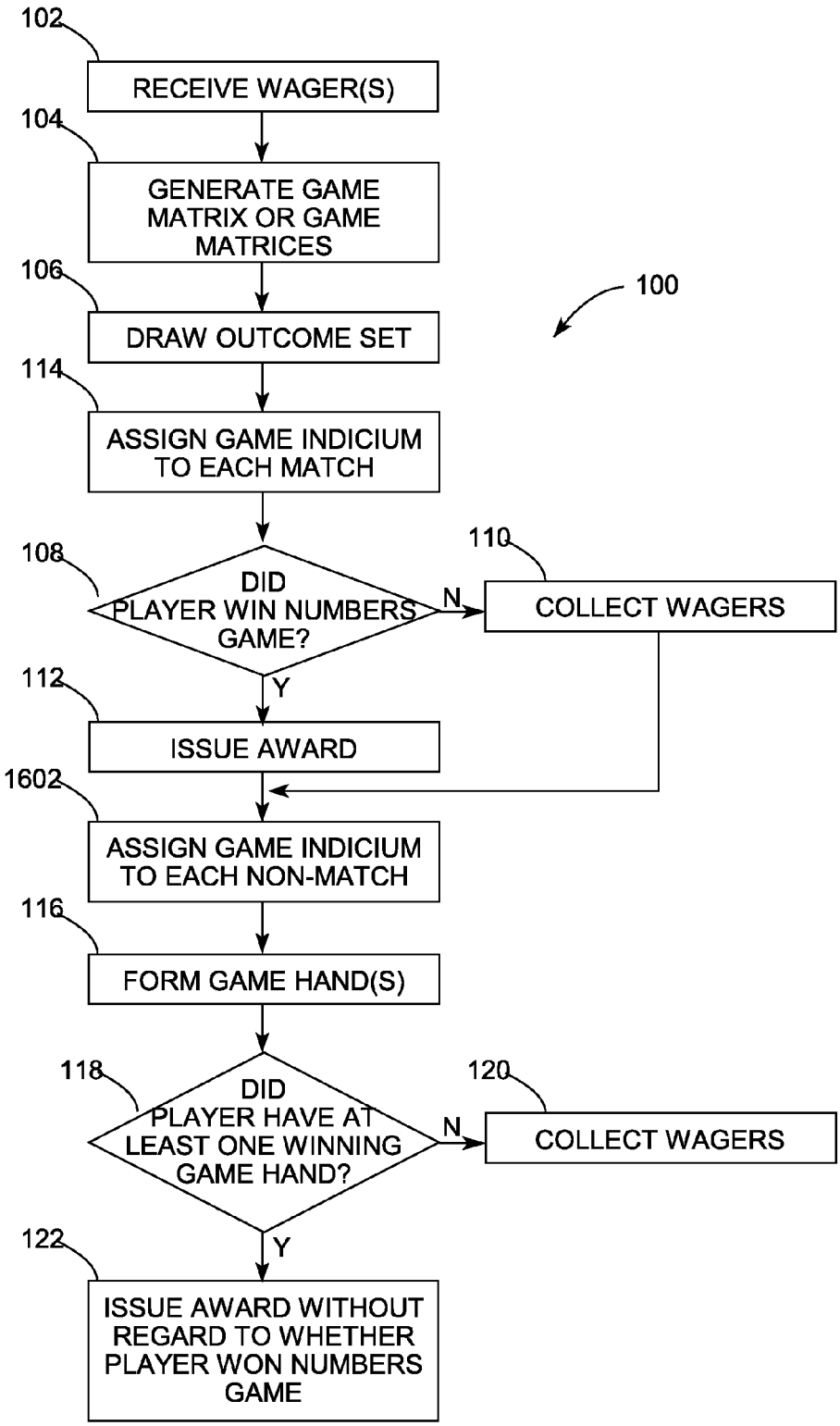
FIG. 16 is a flowchart of a method according to an embodiment of the present invention.

Referring to FIGS. 10A, 10B, and 16, an example embodiment includes conducting a numbers game component of a game and randomly filling in 1602 any empty game matrix positions after the numbers game component is completed and before the game hand component is conducted. Specifically, an outcome set is selected and a game indicium is assigned 114 to each match between a selected member of the outcome set and a number indicium in the game matrix 300. For example, FIG. 10A illustrates a step in a numbers game component in which a number indicium, 1-17 in this example, is selected and associated with the game indicium 6♠. Because the game matrix 300 in this example has a position that matches the number indicium, the position is marked and the 6♠ is displayed on the game matrix 300 at the matrix position containing the match. Again, as described above, the game indicium is dynamically selected at the time the number indicium is drawn and the game indicium is placed into the game matrix 300 only if the game matrix 300 contains the drawn number indicium and at the location of the selected number indicium. FIG. 10B illustrates a step occurring after a numbers game component is completed. As illustrated in FIG. 10B, game indicia placed during the numbers game component are carried through to a game hand component and, in this example, remain in the same locations. For example, matrix position in the first column, first row contained the 2♣ in FIG. 10A and contains the same 2♣ in FIG. 10B.

In this optional embodiment, as illustrated in FIG. 16, the empty matrix positions, that is, the matrix positions that did not have a game indicia assigned during the numbers game component as a result of failing to include a number indicium that matched the randomly drawn number indicia, are filled in by randomly selecting a game indicium for each non-match matrix position and assigning 1602 the randomly selected game indicium to the non-match matrix position. In this example, a single deck is used to fill in all the "empty" positions in the game matrix 300. As discussed above, the previously-dealt game indicia (either all or only those appearing in the game matrix 300 as the result of a match) may be removed from the deck used to fill in the game matrix 300. Put another way, all the game indicia dealt to any matches for any live or virtual player's game matrix may be removed from the deck prior to filling in the non-match matrix positions. Alternatively, only those game indicia currently appearing on the player's game matrix 300 may be removed from the deck and the other game indicia that may have been assigned to other live or virtual players' game matrices may be reintroduced into the deck prior to filling in the non-match matrix positions. Thus, in the latter case, if the player obtains seven matches in a 5×5 matrix of twenty-five positions and a conventional poker deck of fifty-two cards is used to supply game indicia, the deck used to fill in the non-match matrix positions would include forty-five cards, with the seven cards already appearing in the player's game matrix 300 removed. Also, as discussed above, the game matrix may be divided into groupings of matrix positions (e.g., rows, columns, or the like) and a different deck may be used for each grouping. As above, previously-dealt game indicia may be removed from the deck (s) used to fill in the game matrix 300. It is contemplated that wild cards, such as Jokers, may be included in the deck(s) used to fill in the game matrix 300, or may be placed in a fixed location (such as the center of the game matrix 300 or other fixed location). It is also contemplated that other non-game indicia cards may be included in the deck, such as indicia to multiply payouts or trigger features such as bonus payouts, secondary games, progressive payouts, or the like.

As illustrated in FIG. 10B, game hands may be formed based on groupings of matrix positions. In this example, twelve game hands are formed from twelve groupings of matrix positions in the game matrix 300—five rows, five columns, and two diagonals. In this example, the game hands are evaluated by a data processor by comparing the game hands to a pay table of winning hands and associated payouts. In an optional embodiment, winning hands include conventional poker hands. It is contemplated that pay tables may vary according to the method used to evaluate game hands. For example, a pay table for game hands without using wild cards may differ from a "deuces wild" pay table. In a further optional embodiment, as discussed above, game indicia may include indicia, such as payout multipliers, game feature triggers, or the like, that may be used to adjust the payout and direct game play. In yet a further optional embodiment, the quantity of matches contained in a winning game hand may be used to adjust the payout. For example, if a game hand is formed entirely from randomly placed game indicia without any game indicia resulting from matches in the numbers game component, the payout may be derived directly from a pay table. However, if the game hand includes game indicia resulting from one, two, three, four, or five matches in the numbers game component of a game, the payout on the pay table may be multiplied by, for example, two, three, five, ten, or twenty-five, respectively. Table 1 illustrates an example of one such pay table for a conventional "Jacks or Better" poker game.

TABLE 1

| Hand | Payout (Multiplied by 1, 2, 3, 5, 10, or 25 for Hands with 0, 1, 2, 3, 4, or 5 Cards from Numbers Game Matches) |
|---|---|
| Royal Flush | 250 |
| Straight Flush | 50 |
| Four of a Kind | 25 |
| Full House | 10 |
| Flush | 6 |
| Straight | 4 |
| Three of a Kind | 3 |
| Two Pair | 2 |
| Jacks or Better | 1 |

Such an example is illustrated in FIG. 10B. In the example of FIG. 10B, five of the twelve game hands are winning hands. Specifically, the second row contains a pair of Jacks, the first column contains three Kings, the second and third columns contain straights, and the diagonal from the lower left corner to the upper right corner contains a pair of Jacks. Thus, the payout is one credit (for a pair of Jacks or better) for the second row and diagonal, three credits (for three of a kind) for the first column, four credits (for straight) for the second and third columns. As indicated in FIG. 10B, payouts may be multiplied based on the quantity of "hits" contained in the hand. Using a pay table in which payouts for winning hands with zero, one, two, three, four, and five hits are multiplied by one, two, three, five, ten, and twenty-five, respectively, the payout for the second row is multiplied by three, the payout for the first column is multiplied by three, the payout for the second column is multiplied by three, the payout for the third column is multiplied by two (since the "Free" space is considered a hit in this optional embodiment, although it may not be considered a hit in alternate optional embodiments), and the payout for the diagonal is multiplied by two (again, because the "Free" space is considered a hit, although it is not necessary in alternate optional embodiments). It is contemplated that in alternate optional embodiments, the "Free" space may be omitted and/or may be treated as a non-hit for purposes of applying payout multipliers unless the player obtains a match in the center matrix location.

It is noted that alternate examples may include different pay tables and different multipliers (or no multipliers) for hands containing hits (or matches) from the numbers game component of a game. For example, Table 2 illustrates an example for a Jacks or Better poker game with bonus payouts for certain four of a kind hands (often referred to as a "Double Bonus Poker" pay table).

TABLE 2

| Hand | Payout (Multiplied by 1, 2, 3, 5, 10, or 25 for Hands with 0, 1, 2, 3, 4, or 5 Cards from Numbers Game Matches) |
|---|---|
| Royal Flush | 250 |
| Straight Flush | 50 |
| Four of a Kind Aces With 2, 3, 4 | 400 |
| Four of a Kind 2s, 3s, 4s With A, 2, 3, 4 | 200 |
| Four of a Kind Aces | 200 |
| Four of a Kind 2s, 3s, 4s | 100 |
| Four of a Kind 5 Thru Kings | 50 |
| Full House | 25 |
| Flush | 8 |
| Straight | 6 |
| Three of a Kind | 3 |
| Two Pair | 1 |
| Jacks or Better | 1 |

Table 3 illustrates an example optional embodiment for a poker game in which deuces are treated as wild cards, i.e., can substitute for any other card in a poker hand to create the highest ranked hand possible.

TABLE 3

| Hand | Payout (Multiplied by 1, 2, 3, 5, 10, or 25 for Hands with 0, 1, 2, 3, 4, or 5 Cards from Numbers Game Matches) |
|---|---|
| Royal Flush | 250 |
| Four Deuces | 200 |
| Wild Royal Flush | 25 |
| Five of a Kind | 15 |
| Straight Flush | 10 |
| Four of a Kind | 8 |
| Full House | 4 |
| Flush | 3 |
| Straight | 2 |
| Three of a Kind | 1 |

Table 4 illustrates yet another example optional embodiment for a poker game in which a conventional poker deck is supplemented with a Joker which is treated as a wild card.

TABLE 4

| Hand | Payout (Multiplied by 1, 2, 3, 5, 10, or 25 for Hands with 0, 1, 2, 3, 4, or 5 Cards from Numbers Game Matches) |
|---|---|
| Royal Flush | 250 |
| Five of a Kind | 200 |
| Wild Royal Flush | 100 |
| Straight Flush | 50 |
| Four of a Kind | 25 |
| Full House | 10 |
| Flush | 6 |
| Straight | 5 |
| Three of a Kind | 2 |
| Two Pair | 1 |
| Kings or Better | 1 |

As may be appreciated, the pay tables listed above may vary in alternate optional embodiments with different payout amounts or different winning game hands. It is contemplated, as noted above, that the present method could be applied to any type of winning game hands and is not necessarily limited to poker or poker-type games.

For example, in an alternate optional embodiment, a method according to an embodiment of the present invention could be applied to a method for awarding in-game prizes using prize indicia. As a preliminary matter, it is contemplated that a method for awarding in-game prizes using prize indicia could be applied to any game and would not be limited to numbers games. Moreover, prize indicia could be awarded for any of a variety of activities, whether or not game related. For example, a background software application could be installed on a device and award prize indicia for performing specified activities, time performing specified activities, or the like to both promote and advertise the prize and the sponsor of the prize and drive the user's behavior. Such a system could be voluntary, thereby allowing prizes to be awarded (and thus products and companies to be marketed) to computer users/players who opted into the system. Any information collected from the computer user/player would be voluntary and, thus, could reduce concerns on the part of the computer user/player about surreptitious data mining.

Figure 14A:
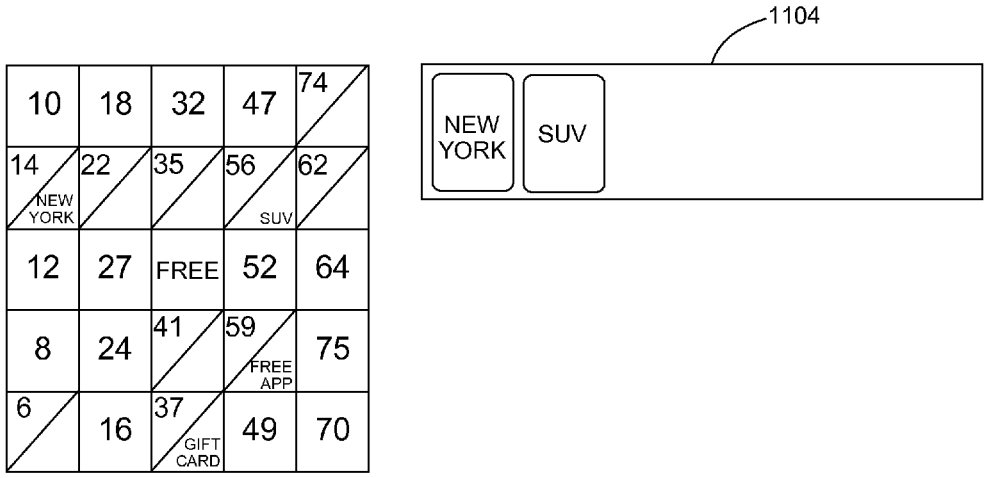
FIG. 14A is a front view of a display of an example game according to an embodiment of the present invention.
Figure 14B:
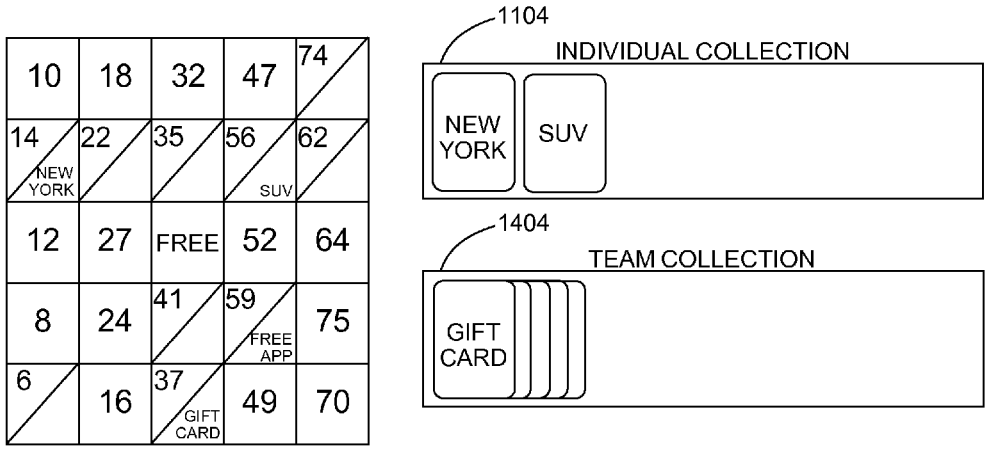
FIG. 14B is a front view of a display of an example game according to the embodiment of FIG. 14A.
Figure 15A:
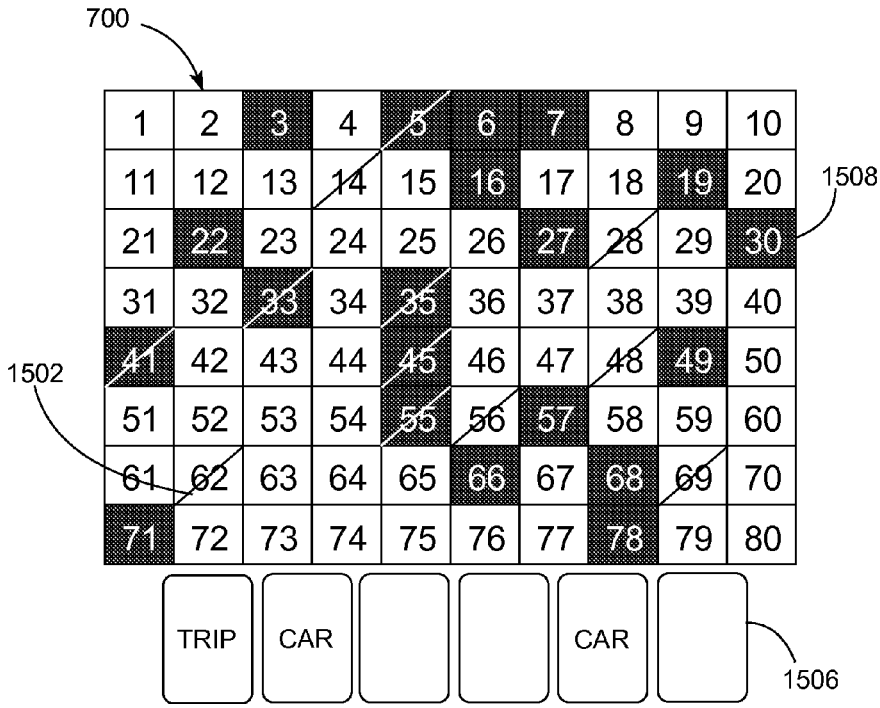
FIG. 15A is a front view of a display of an example game according to an embodiment of the present invention.
Figure 15B:
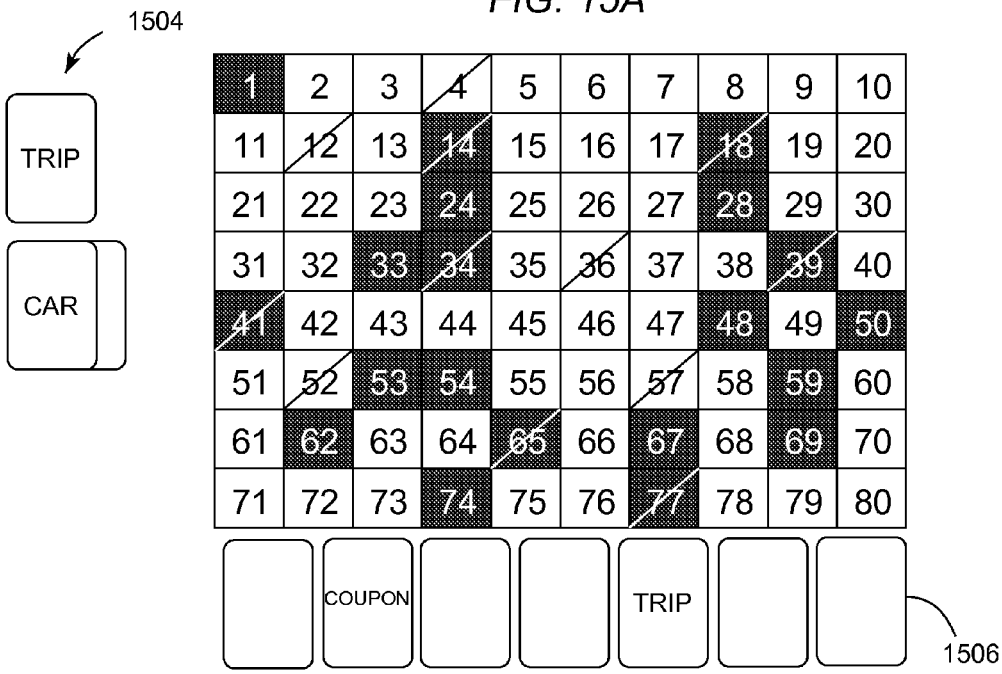
FIG. 15B is a front view of a display of an example game according to the embodiment of FIG. 15A.
Figure 15C:
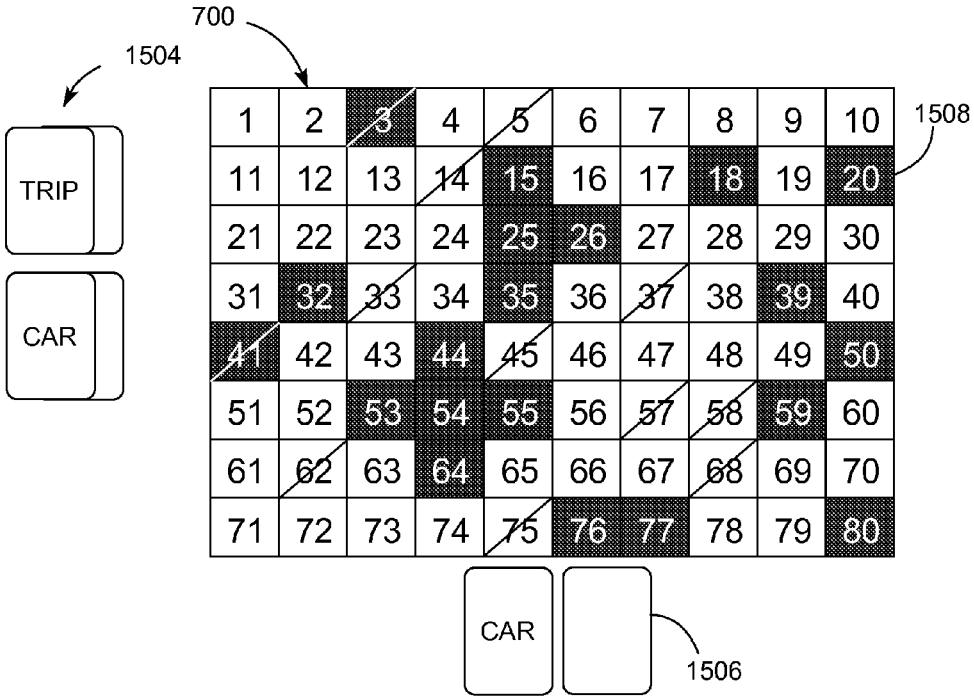
FIG. 15C is a front view of a display of an example game according to the embodiment of FIG. 15A.
Figure 17:
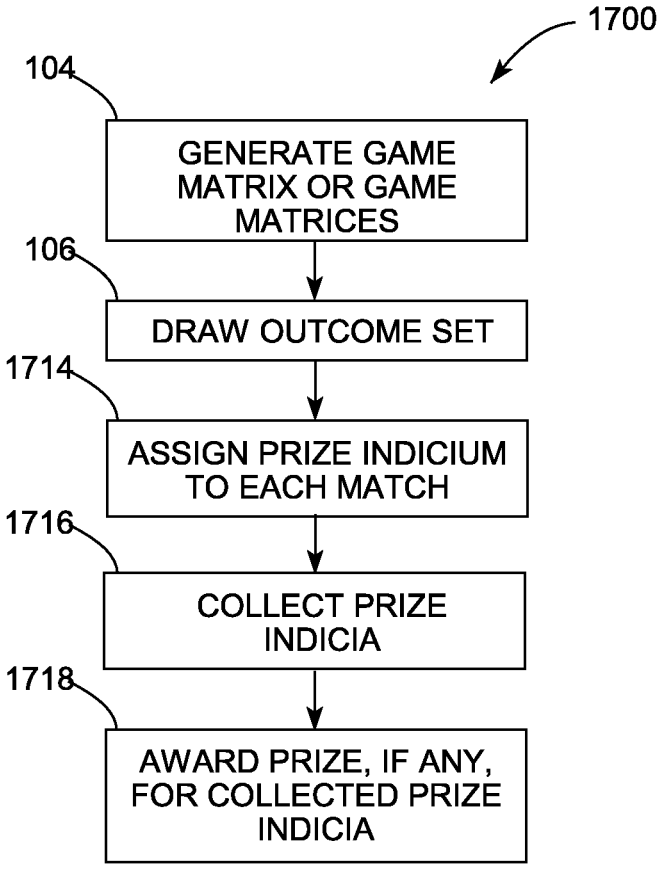
FIG. 17 is a flowchart of a method according to an embodiment of the present invention.

One such optional embodiment applied to a game is illustrated in FIG. 17. A numbers game includes generating and displaying at least one game matrix 300, 700 at the display 204. Again, the game matrix or game matrices 300, 700 may depend on the specific game with, for example, different game matrices generated for Keno, Bingo, or other numbers games. Examples Bingo games including prize indicia (e.g., Prize Bingo games) are illustrated in FIGS. 11A-11H, 12A-12B, 13, and 14A-14B while Keno games including prize indicia (e.g., Prize Keno games) are illustrated in FIGS. 15A-15B. As noted above, a Bingo game matrix 300 contains a fixed subset of the available number indicia 1102, e.g., Bingo numbers and a Keno game matrix 700 includes input from the player through the player interface 206 to select one or more number indicia 1502, e.g., Keno numbers, in a game matrix 700 containing all available number indicia 1502.

The numbers component of the game may be conducted substantially as previously described. Specifically, a data processor 202 conducts a numbers game component of a game by generating an outcome set of drawn number indicia 1102, 1502 and comparing the numbers drawn for the outcome set to the game matrix or game matrices 300, 700.

For example, in an optional embodiment directed to Bingo, the drawn number indicia 1102 are compared to the subset of number indicia displayed in the game matrix or game matrices 300. If a game matrix 300 includes a predetermined pattern of matches, the data processor 202 issues a reward to the player for the numbers game component of a game.

In an optional Keno embodiment, an outcome set containing a fixed quantity of number indicia is drawn and the drawn number indicia 1502 of the outcome set are compared to the number indicia 1508 selected by the player. If the player obtained a threshold quantity of matches, the data processor 202 issues a reward to the player for a numbers game component of a game.

Figure 11A:
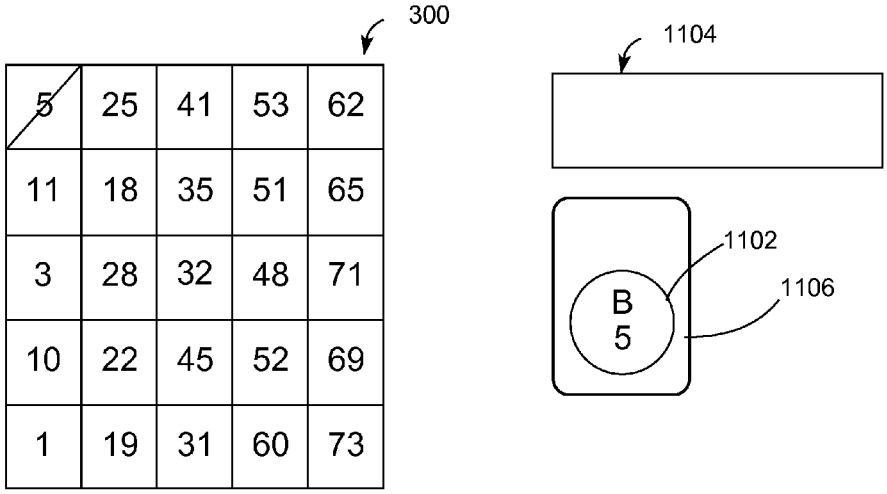
FIG. 11A is a front view of a display of an example game according to an embodiment of the present invention.
Figure 11B:
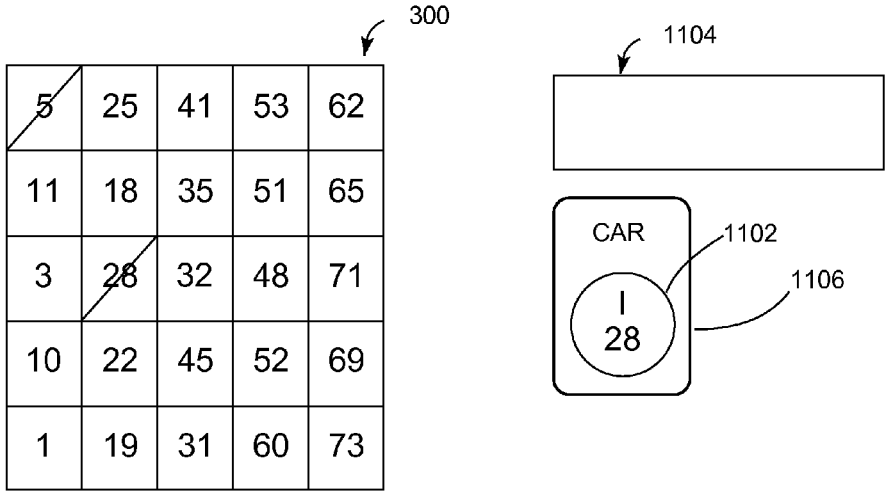
FIG. 11B is a front view of a display of an example game according to the embodiment of FIG. 11A.

The data processor 202 conducts a prize component of the game. As illustrated in the example of FIGS. 11A, 11B, and 17, in an optional embodiment, the data processor 202 assigns 1714 a prize indicium 1106, 1506 to each match. Although the examples illustrated show the prize indicia 1106, 1506 as prize cards, it is contemplated that prize indicia 1106, 1506 may be displayed in any manner.

Prize indicia may represent prizes and may be assigned in any manner. For example, in one optional embodiment, prize indicia are selected from a predefined set of prize indicia analogous to a predefined "deck" of prize cards. In this manner, the set of prize indicia can be set to reflect both the availability of prizes and the odds of awarding the prizes. Put simply, the occurrence of a prize would be directly related to the relative quantity of prize cards representing that prize to the overall prize cards available. In an optional embodiment, prize indicia may include "blank" prize indicia or other prize indicia not associated with a prize. By adjusting the constitution of the set of prize indicia using "blank" or no-prize prize indicia, a game operator could precisely set the odds of winning a specific prize as well as the overall odds of winning any prize. In the example of FIG. 11A, a match for the number indicium B-5 is assigned a "blank" prize indicium while a match for the number indicium I-28 has been assigned a "car" prize indicium.

In one optional embodiment, prize indicia are only assigned to matches obtained during the course of the numbers game component of a game. In an alternate embodiment, the prize component of the game is conducted after the numbers game component of a game and any matrix position within the game matrix 300 or game matrices that do not include a match, i.e., contain a number indicium not drawn, may be assigned a prize indicium 1106, 1506. That is, in one optional embodiment, game matrices 300 are filled in after completing the numbers game with randomly selected prize indicia 1106. In one optional embodiment, game matrices 300 are filled in with prize indicia 1106 randomly selected from prize indicia 1106 remaining in the inventory or deck of prize indicia 1106 after the numbers game component of the game is completed. Thus, in such an optional embodiment, previously assigned prize indicia, whether or not they appear on the player's game matrix 300, are unavailable to be assigned during a stage in which matrix positions with unselected number indicia are randomly assigned prize indicia.

Figure 11C:
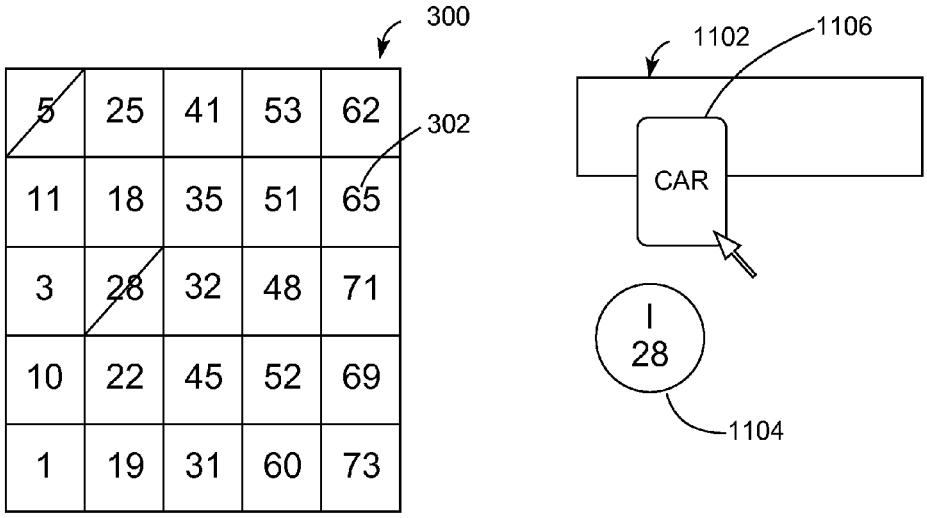
FIG. 11C is a front view of a display of an example game according to the embodiment of FIG. 11A.
Figure 11D:
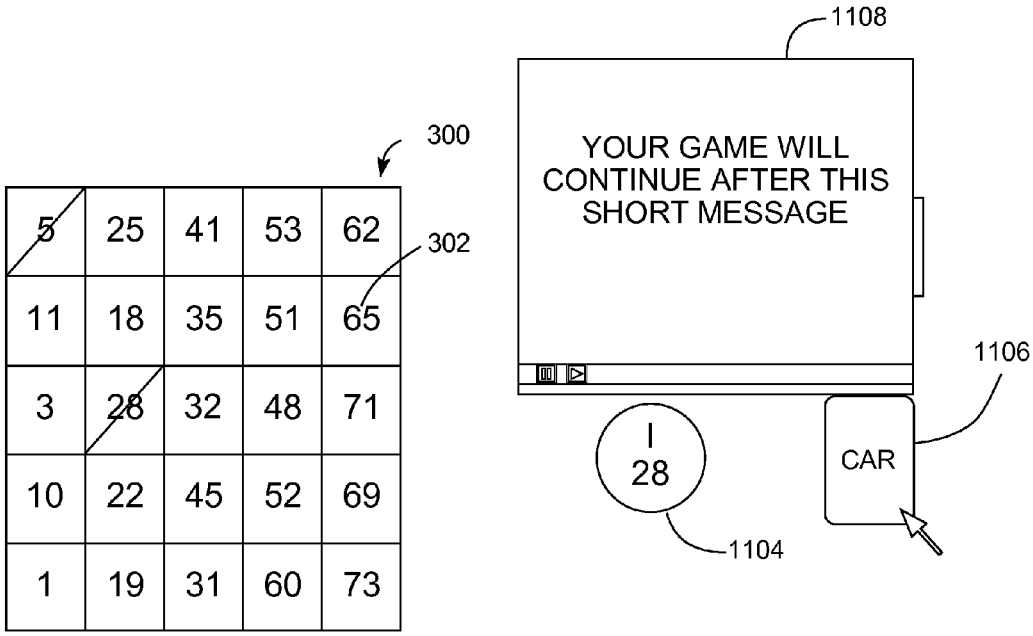
FIG. 11D is a front view of a display of an example game according to the embodiment of FIG. 11A.

The prize indicia 1106, 1506 are collected 1716. In an optional embodiment, prize indicia may be stored in a register or other holding area 1104, 1504. Specifically, in an optional embodiment, prizes may be provided by sponsors and prize indicia 1106, 1506 associated with the sponsored prize may serve to promote and advertise the prize and sponsor. It is contemplated that in such an optional embodiment, the in-game prizes would provide advertising and marketing opportunities that are desired by the player and, thus, may be more effective in promoting the advertiser than banner advertising, pop-up advertising, or the like. In one such optional embodiment, interaction between the user and the prize indicia 1106, 1506 may be desirable. For example, as illustrated in FIG. 11C, the player may drag the prize indicium 1106 to a register 1104 where the prize indicium 1106 is displayed during the game. In an additional or alternate optional embodiment illustrated in FIG. 11D, an advertisement may be displayed in a pop-up window 1108 when the prize indicium 1106 is assigned, dragged by the player, selected by the player, or the like.

Figure 11E:
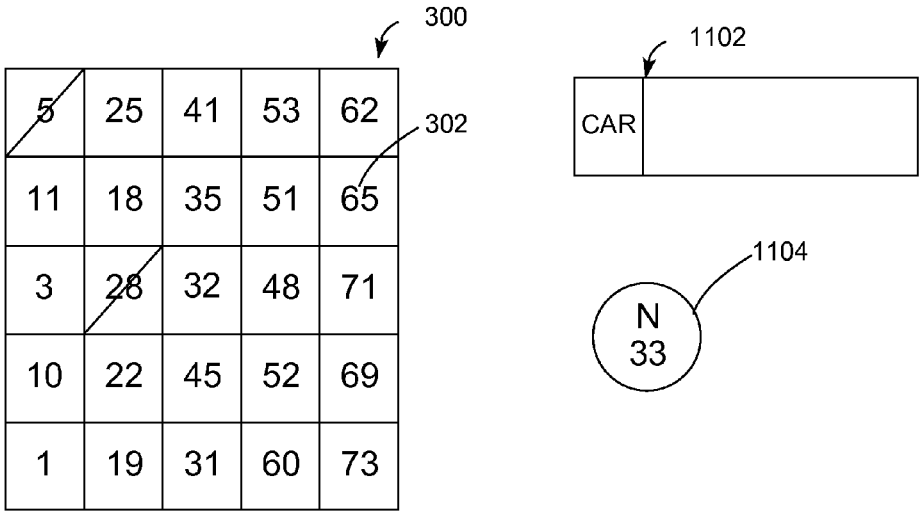
FIG. 11E is a front view of a display of an example game according to the embodiment of FIG. 11A.
Figure 11F:
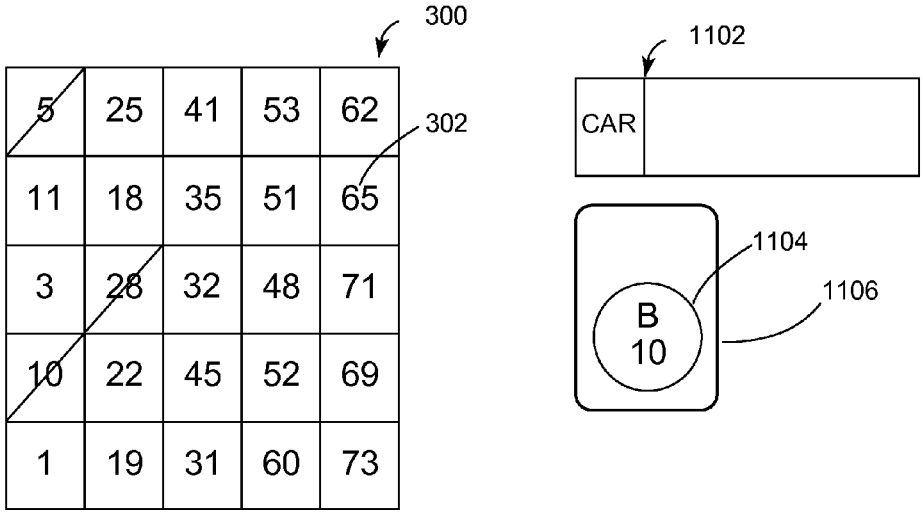
FIG. 11F is a front view of a display of an example game according to the embodiment of FIG. 11A.
Figure 11G:
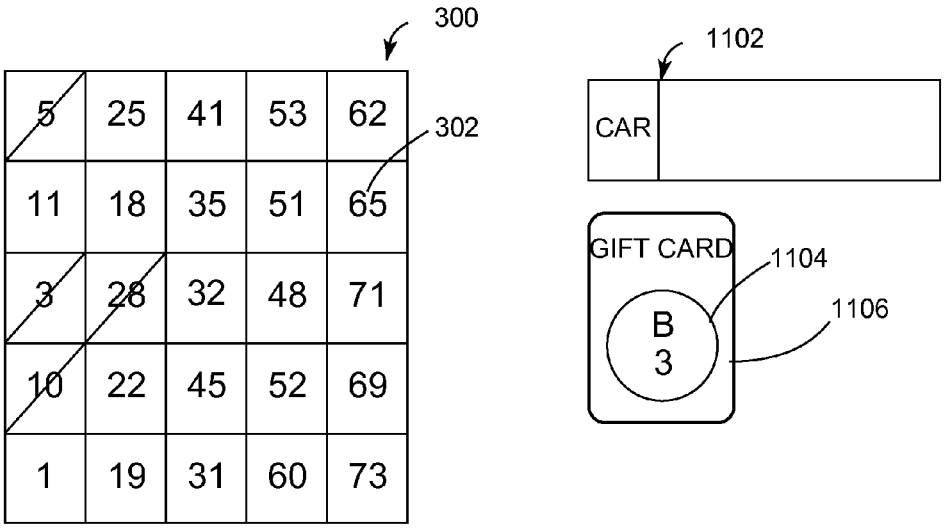
FIG. 11G is a front view of a display of an example game according to the embodiment of FIG. 11A.
Figure 11H:
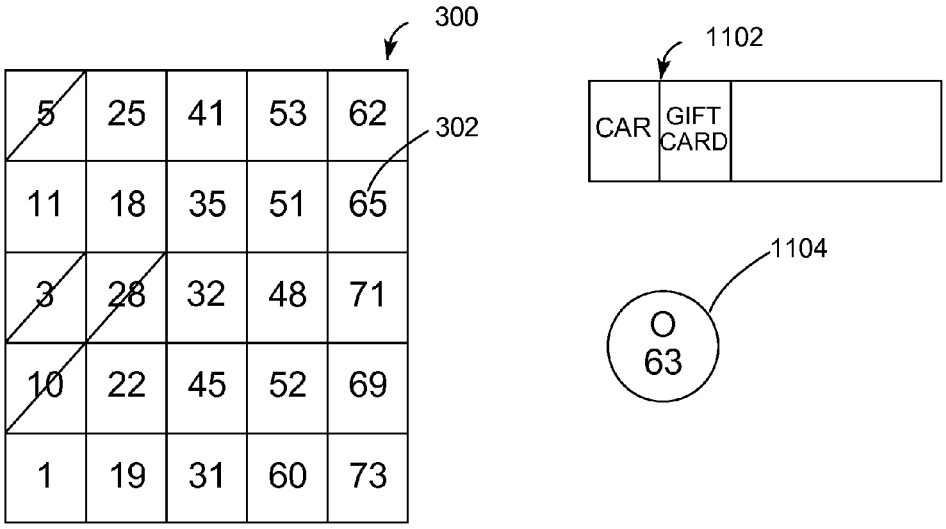
FIG. 11H is a front view of a display of an example game according to the embodiment of FIG. 11A.

As illustrated in FIGS. 11E and 11G, a prize component may occur simultaneous with a numbers game component with numbers indicia 1104 not matching the game matrix 300 resulting in no prize indicium selection (as shown in FIG. 11E) and numbers indicia 1104 matching the game matrix 300 resulting in the selection of a prize indicium 1106. In an optional embodiment, prize indicia 1106 may all be stored in a single register 1104 regardless of whether they match. As illustrated in FIGS. 11G and 11H, a prize indicia 1106 for a "gift card" may be stored in a register 1104 with other prize indicia 1106 selected during the game.

Prizes may be awarded 1718 for collected prize indicia 1106 in a numbers game. That is, in one optional embodiment, collected prize indicia 1106 may be redeemed for prizes associated with those prize indicia. It is contemplated that the criteria for awarding a prize may be uniform for all prizes or vary from prize to prize. For example, in one optional embodiment, prizes may be awarded for collecting and redeeming a plurality of matching prize indicia 1106. Again, in such an optional embodiment, the frequency of awarding prizes may be determined, at least partially, by the quantity of prize indicia needed to claim a prize. Thus, a valuable prize, such as a car, could require the collection of multiple prize indicia 1106 to obtain the prize. As discussed above, each prize indicium 1106 could be viewed as an opportunity to promote and market the prize and the sponsor through commercials, interactive features with the prize indicium, or the like. In addition to functioning to award prizes, prize indicia may also serve as coupons, discounts, offers, or the like to further promote and market the prize and/or prize sponsor. In such optional embodiments, the prize indicia may be redeemed electronically, printed and redeemed in a physical form, or redeemed in any other manner.

It is contemplated that prize indicia 1106 collected in a game may expire at the end of the game and be removed from the player's register 1104, such that the player starts anew collecting prize indicia 1106 in each new game. Alternatively, prize indicia 1106 may be carried over across two or more games, thereby allowing the player multiple games to collect a sufficient number of prize indicia 1106 to be awarded a prize. In such an optional embodiment, prize indicia 1106 in a player's register 1104 may expire after a predetermined number of games, expire after a predetermined amount of time, persist until the prize associated with the prize indicia 1106 is awarded, or the like.

Figure 12A:
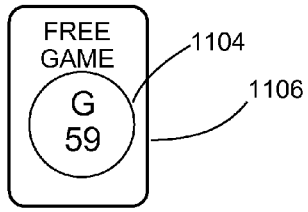
FIG. 12A is a front view of a display of an example game according to an embodiment of the present invention.

In a further or alternate optional embodiment, prizes may be awarded for collecting a single prize indicium. As illustrated in FIG. 12A, a prize indicium 1106 which, by itself, results in the award of a prize may be displayed to the player as an "instant winner" prize indicium 1106. Put another way, in an optional embodiment, an instant win prize may be issued for a player who collects and redeems a single prize indicium 1106. It is contemplated that in an optional embodiment, a prize game may include instant winner prize indicia 1106 which only require one prize indicium 1106 to win as well as collectible prize indicia 1106 which may require collection of multiple prize indicia 1106 to win.

Figure 12B:
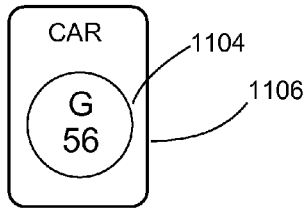
FIG. 12B is a front view of a display of an example game according to the embodiment of FIG. 12A.
Figure 13:
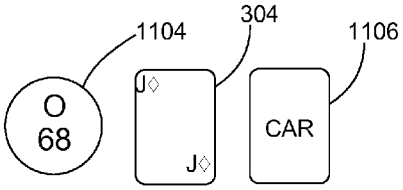
FIG. 13 is a front view of a display of an example game according to an embodiment of the present invention.

As illustrated in FIG. 12B, it is noted that the numbers game component may result in awards for winning the numbers game or may be for entertainment only. That is, winning the numbers game component, e.g., obtaining a predetermined pattern of matches in Bingo such as a row, column, diagonal, or the like, may result in an award to the player. In one such optional embodiment, awards for winning the numbers game component may be separate and independent of any prizes in a prize game component. Alternatively, the numbers game component may be conducted for entertainment value and the only awards may be prizes in the prize component of the game. In yet a further optional embodiment, illustrated in FIG. 13, the prize component may be combined with the numbers game component and a game hand component, such that the game involves simultaneously conducting a numbers game, forming game hands using game indicia, collecting prize indicia. It is contemplated that the awards may be offered for neither, either, or both the numbers game component and game hand component of the game in addition to any prizes offered in the prize game component.

As discussed above, a numbers game component may be conducted as a social game among live players, a gambling game against live players and/or virtual players and/or the game operator, or a mixture thereof. When implemented as a social game, the player interface may include 206 social game features such as a means to allow players to chat, send messages, view online contacts, and so forth. In a further optional embodiment, the player interface 206 may include features to allow players to share and/or exchange prizes and/or prize indicia.

Additionally or alternatively, players in a gambling or social game may form teams for purposes of a prize game. As illustrated in FIGS. 14A and 14B, a prize game may include a team prize register 1402 that tracks team prize indicia 1404. In one optional embodiment, such team prize indicia 1404 may be added to the team prize register 1402 when any member of the team obtains the team prize indicia 1404. Thus, a team of four players could be eligible for a team prize represented by team prize indicia 1404 regardless of which player(s) contributed to the team prize indicia 1404 in the team prize register 1402, as long as the criteria are satisfied for obtaining the team prize. In the optional embodiment illustrated in FIGS. 14A and 14B include separate registers for team prize indicia 1404 and individual prize indicia 1106. However, it is contemplated that a game may only include a single register for both team prize indicia 1404 and individual prize indicia 1106. Alternatively, it is contemplated that a game may only include team prize indicia 1404 and offer no individual prize indicia 1106.

Figure 15D:
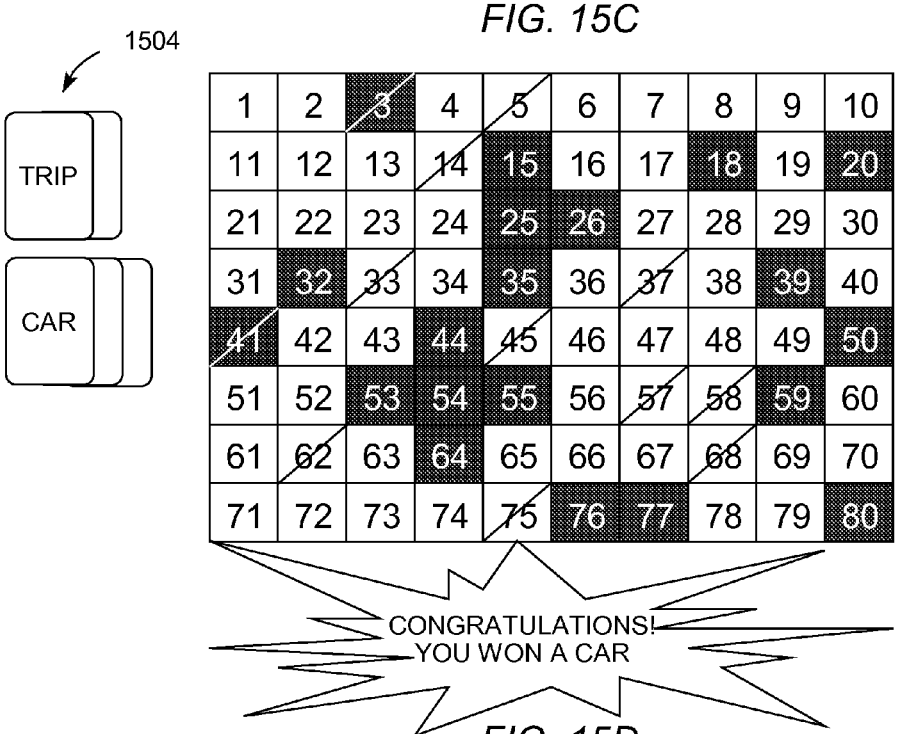
FIG. 15D is a front view of a display of an example game according to the embodiment of FIG. 15A.

In an optional embodiment, a prize game may be applied to Keno as illustrated in FIGS. 15A-15D. In FIG. 15A, a player selects twelve Keno numbers in a first game. The player "catches" six matches which result in six prize indicia 1506, e.g., one prize indicium 1506 for each match. As illustrated in FIG. 15A, the prize indicia 1506 include both blank prize indicia and prize indicia with prizes identified. These prize indicia are carried to a subsequent game illustrated in FIG. 15B in which the player "catches" seven matches and obtains seven additional prize indicia 1506. These prize indicia 1506 are added to the register 1504 containing prize indicia 1506 obtained in the previous game. In a subsequent game shown in FIG. 15C, the player "catches" two more matches and obtains two additional prize indicia 1506. As illustrated in FIG. 15D, the prize indicia 1506 obtained in the game of FIG. 15C results in a collection over the three games of enough prize indicia 1506 to be awarded a prize.

While certain embodiments of the present invention have been shown and described it is to be understood that the present invention is subject to many modifications and changes without departing from the spirit and scope of the invention presented herein.

I claim:

1. A method for conducting a game at a electronic device having a data processor in communication with a display, a data storage device, and a player interface, the method comprising:

storing at said data storage device at least one matrix template having a plurality of matrix positions;

storing a plurality of number indicia at said data storage device;

storing a plurality of game indicia at said data storage device;

receiving a wager through said player interface;

in response to receipt of said wager, generating at least one game matrix by said data processor by assigning a plurality of number indicia to a plurality of matrix positions in at least one matrix template;

displaying said game matrix at said display;

resolving said wager by said data processor comprising:

randomly selecting an outcome set of number indicia by said data processor;

comparing said outcome set to said game matrix by said data processor and identifying by said data processor each match between said outcome set and a number indicium in said game matrix;

determining an award, if any, for said game matrix based on predetermined patterns of matches in said game matrix;

randomly selecting by said data processor of a game indicium to correspond to each match and placing each randomly selected game indicium at the location in said game matrix of the corresponding match;

after determining an award for said game matrix based on predetermined patterns of matches in said game matrix, randomly selecting by said data processor of a game indicium for each location in said game matrix without a match to thereby fill said game matrix with game indicia;

after filling said game matrix with game indicia, grouping game indicia based on a predetermined pattern in said game matrix into a plurality of game hands; and determining an award, if any, for said plurality of game hands.

2. The method of claim 1 wherein said step of determining an award for said at least one game hand comprises comparing by said data processor of said at least one game hand to a table of winning hands stored at said data storage device.

3. The method of claim 1 further comprising storing at said data storage device a definition of a deck of game indicia such that said each game indicium randomly selected to correspond to each match in said game matrix is selected from a single deck.

4. The method of claim 3 further comprising:

removing from said deck by said data processor each game indicium selected to correspond to each match in said game matrix; and selecting by said data processor each game indicium corresponding to each location in said game matrix without a match from said deck excluding removed game indicia.

5. The method of claim 1 further comprising:

storing a plurality of prize indicia at said data storage device, wherein each of said prize indicia advertises and identifies a prize, said prize awarded if a predetermined quantity of one or more of said prize indicia are collected;

randomly selecting by said data processor of a prize indicium to correspond to each match; and determining a prize, if any, for said prize indicia by said data processor.

* * * * *